US011834302B2

(12) United States Patent
Brook et al.

(10) Patent No.: US 11,834,302 B2
(45) Date of Patent: Dec. 5, 2023

(54) STAIRLIFT

(71) Applicant: Bruno Independent Living Aids, Inc., Oconomowoc, WI (US)

(72) Inventors: Allen Edward Brook, Waterford, WI (US); Terrence E. O'Brien, Oconomowoc, WI (US); Roy E. McDaniels, Jr., Watertown, WI (US); Scott Martin Hall, Sussex, WI (US); Eduard Jozef Marie Duijnstee, Ouderkerk aan den IJssel (NL)

(73) Assignee: BRUNO INDEPENDENT LIVING AIDS, INC., Oconomowoc, WI (US)

( * ) Notice: Subject to any disclaimer, the term of this patent is extended or adjusted under 35 U.S.C. 154(b) by 41 days.

(21) Appl. No.: 17/595,700

(22) PCT Filed: May 29, 2020

(86) PCT No.: PCT/US2020/035092
§ 371 (c)(1),
(2) Date: Nov. 22, 2021

(87) PCT Pub. No.: WO2020/243410
PCT Pub. Date: Dec. 3, 2020

(65) Prior Publication Data

US 2022/0081256 A1 Mar. 17, 2022

Related U.S. Application Data

(60) Provisional application No. 62/886,615, filed on Aug. 14, 2019, provisional application No. 62/855,158, filed on May 31, 2019.

(51) Int. Cl.
*B66B 9/08* (2006.01)

(52) U.S. Cl.
CPC ..... *B66B 9/0815* (2013.01); *B66B 9/0838* (2013.01); *B66B 9/0846* (2013.01)

(58) Field of Classification Search
CPC ... B66B 9/0815; B66B 9/0838; B66B 9/0846; B66B 9/08
See application file for complete search history.

(56) References Cited

U.S. PATENT DOCUMENTS 3,121,476 A * 2/1964 Mazzarelli ..... B66B 9/0838 187/406
4,260,869 A * 4/1981 Slavens ..... B23K 37/0217 219/60 A (Continued)

FOREIGN PATENT DOCUMENTS

CN 108787799 A 11/2018
EP 1124749 B1 3/2004

(Continued)

OTHER PUBLICATIONS

International Search Report from International Patent Application No. PCT/US2020/035092 dated Aug. 7, 2020, 1 page.

(Continued)

*Primary Examiner* — Michael A Riegelman
(74) *Attorney, Agent, or Firm* — Klintworth & Rozenblat IP LLP

(57) ABSTRACT

A stairlift includes a rail and a carriage. The carriage includes a frame, a central drive unit mounted to the frame, the central drive unit including a drive motor and a drive gear, a yoke assembly pivotably mounted to the frame, and a first bogie unit attached to the yoke assembly and a second bogie unit attached to the yoke assembly, wherein each bogie unit includes a bogie socket mounted to the yoke assembly, and a bogie ball spherically pivotable within the bogie socket, the bogie ball including a plurality of bogie ball rollers configured to hold the bogie ball to the rail, and (Continued)

further wherein the plurality of bogie ball rollers are configured to maintain the bogie ball in a generally perpendicular travel orientation relative to the rail.

20 Claims, 21 Drawing Sheets

(56) References Cited

U.S. PATENT DOCUMENTS 4,838,412 A * 6/1989 Backman ..... E01B 25/24 104/106
4,904,916 A 2/1990 Glaske et al.
5,052,521 A * 10/1991 Wendt ..... B66B 9/083 187/202
5,235,917 A * 8/1993 Luck ..... B61C 13/04 105/101
5,676,061 A * 10/1997 Loomer ..... B61B 13/04 104/118
5,967,265 A * 10/1999 Bruno ..... B66B 9/0838 187/202
6,082,496 A * 7/2000 Bovis ..... B66B 9/0815 187/200
6,155,382 A * 12/2000 Duijnstee ..... B66B 9/0815 187/245
6,360,673 B1 * 3/2002 Herrin ..... B65G 47/962 104/118
6,435,308 B2 * 8/2002 Grass ..... B66B 9/0815 198/321
6,622,637 B2 * 9/2003 Cummins ..... B61F 5/22 105/199.1
6,755,136 B2 * 6/2004 Jenkins ..... B66B 9/0815 105/141
6,761,250 B1 * 7/2004 Szentistvany ..... B66B 9/0846 187/249
7,145,433 B2 * 12/2006 Gerstenkorn ..... G07C 9/21 340/5.7
7,296,659 B2 * 11/2007 Carlsen ..... B66B 9/0846 187/201
7,322,461 B2 * 1/2008 Szentistvany ..... B66B 9/0846 104/93
8,360,336 B2 * 1/2013 Luckett ..... F16H 55/26 238/123
8,485,317 B2 * 7/2013 Gerstenkorn ..... B66B 1/468 187/247
8,607,936 B2 * 12/2013 Szentistvany ..... B66B 9/0807 104/231
8,660,565 B2 2/2014 Hall
9,016,437 B2 * 4/2015 DiGiovanni ..... B66B 9/0846 187/200
9,338,617 B2 * 5/2016 Douglas ..... H04W 4/80
9,457,992 B2 * 10/2016 Ooms ..... B66B 9/08
9,751,724 B2 * 9/2017 Ooms ..... B66B 9/08
9,751,725 B2 * 9/2017 Hall ..... B66B 9/0853
9,850,093 B2 * 12/2017 DePaola ..... G07C 9/00896
9,908,745 B2 * 3/2018 De Kroon ..... B66B 9/08
10,011,462 B2 * 7/2018 Ooms ..... B66B 9/0846
10,118,797 B2 * 11/2018 Keser ..... H04W 4/33
10,224,768 B2 * 3/2019 Zanotti ..... H02K 1/27
10,625,981 B2 * 4/2020 Rosenthal ..... B66B 9/0838
10,843,901 B2 * 11/2020 Hoedjes ..... B66B 9/0838
11,111,107 B2 * 9/2021 Duijnstee ..... B66B 19/00
D933,330 S * 10/2021 Brook ..... D34/35
11,560,290 B2 * 1/2023 Lodi ..... B66B 9/0846
2002/0011383 A1 * 1/2002 Grass ..... B66B 9/0853 187/245
2004/0104078 A1 * 6/2004 Szentistvany ..... B66B 9/0846 187/245
2004/0255709 A1 * 12/2004 Reitberger ..... B23Q 1/015 74/422
2005/0177288 A1 * 8/2005 Sullivan ..... B60W 50/02 307/10.1
2005/0279580 A1 * 12/2005 Szentistvany ..... B66B 9/0815 187/201
2008/0271953 A1 * 11/2008 Vroegindeweij ..... B66B 9/0838 187/245
2010/0064835 A1 * 3/2010 Luckett ..... F16H 55/26 219/615
2010/0101894 A1 * 4/2010 Szentistvany ..... B66B 9/0838 187/200
2011/0024237 A1 * 2/2011 Vroegindeweij ..... B66B 9/0838 187/201
2011/0278096 A1 * 11/2011 Kentenich ..... B66B 1/34 187/200
2012/0048652 A1 * 3/2012 DiGiovanni ..... B66B 9/0815 187/201
2014/0083801 A1 * 3/2014 Vroegindeweij ..... B66B 9/0815 187/201
2015/0375965 A1 * 12/2015 Awerbuch ..... B66B 9/0815 187/201
2016/0236906 A1 * 8/2016 Horton ..... B66B 9/0846
2016/0268805 A1 * 9/2016 Finn ..... H02J 7/35
2017/0001837 A1 * 1/2017 Hall ..... B66B 9/0853
2017/0144860 A1 * 5/2017 Colenutt ..... B66B 5/044
2017/0158464 A1 * 6/2017 De Kroon ..... B66B 9/0815
2017/0233223 A1 * 8/2017 Hoedjes ..... B66B 9/0838 187/201
2017/0247227 A1 * 8/2017 Rosenthal ..... B66B 9/0838
2019/0047825 A1 * 2/2019 Jakes ..... B66B 9/08
2019/0225460 A1 * 7/2019 Duijnstee ..... B66B 9/0838
2020/0239282 A1 * 7/2020 Lodi ..... B66B 9/0815
2022/0081256 A1 * 3/2022 Brook ..... B66B 9/0815
2022/0081257 A1 * 3/2022 Brook ..... B66B 9/0846

FOREIGN PATENT DOCUMENTS

EP 3215450 B1 11/2015
GB 2367807 A 4/2002
GB 2551817 A 1/2018
KR 2001-0055394 A 7/2001
WO 2000/23371 A1 4/2000
WO 2018/002573 A1 1/2016
WO 2016/072849 A1 5/2016

OTHER PUBLICATIONS

Notification Concerning Transmittal of International Preliminary Report on Patentability from International Patent Application No. PCT/US2020/035092 dated Dec. 9, 2021, 1 page.
International Preliminary Report on Patentability from International Patent Application No. PCT/US2020/035092 dated Nov. 16, 2021, 6 pages.
English machine translation of CN 108787799.
English machine translation of KR2001-0055394.

* cited by examiner

STAIRLIFT

RELATED APPLICATIONS

This application claims the domestic benefit of U.S. Provisional Application Ser. No. 62/855,158 filed on May 31, 2019 and U.S. Provisional Application Ser. No. 62/886,615 filed on Aug. 14, 2019.

FIELD OF THE DISCLOSURE

The disclosure relates to stairlifts capable of conveying a load along a stairway or other travel path.

BACKGROUND

Stairlifts (also referred to as chair lifts, stairway elevators, and other, similar names) transport people and/or other cargo up and down inclined paths such as stairways. Stairlifts include a rail and a carriage carried by the rail and movable along the rail.

The carriage includes a frame which may include rollers which ride on the rail, a load support attached to the frame and supporting a load, such as a chair or wheelchair platform, and a carriage drive attached to the frame to drive the frame and load support along the rail. The carriage drive may include a motor and a rack and pinion, screws, chains, cables, belts, and the like driven by the motor to cause the carriage and its associated load support to move along the rail. The load support is rotatably connected to the frame by a rotation device, such that load support rotates about a horizontal axis relative to the carriage. A control unit controls the rotation device, such that the load support is positioned in a desired orientation relative to a horizontal plane. The rotation device includes a motor and a rotator, where the motor is operatively connected to the load support via the rotator to cause rotation of the load support relative to the carriage about the horizontal axis.

The rail is mounted adjacent to or on the stairs and the carriage is attached to the rail. A person seated on the load support or cargo loaded on the load support may be moved up or down the stairway along the rail. The rails may be straight or curved.

SUMMARY OF THE INVENTION

One aspect of the invention is a carriage for a stairlift including a frame, a central drive unit mounted to the frame, the central drive unit including a drive motor and a drive gear, a yoke assembly pivotably mounted to the frame, a first bogie unit attached to the yoke assembly, and a second bogie unit attached to the yoke assembly, wherein each bogie unit includes a socket mounted to the yoke assembly, and a ball pivotable within the socket, the ball including a plurality of rollers configured to hold the ball to a rail.

Another aspect of the invention is a stairlift comprising a rail and the above-described carriage, wherein the plurality of rollers is configured to hold the ball to the rail.

In a preferred embodiment, the rail is curved and the plurality of rollers are preferably configured to maintain the ball in a generally perpendicular travel orientation relative to the rail when the carriage is moved over a curved portion of the rail.

BRIEF DESCRIPTION OF THE DRAWINGS

Many aspects of the disclosure can be better understood with reference to the following drawings. While several implementations are described in connection with these drawings, the disclosure is not limited to the implementations disclosed herein. On the contrary, the intent is to cover all alternatives, modifications, and equivalents.

DETAILED DESCRIPTION

Figure 1:
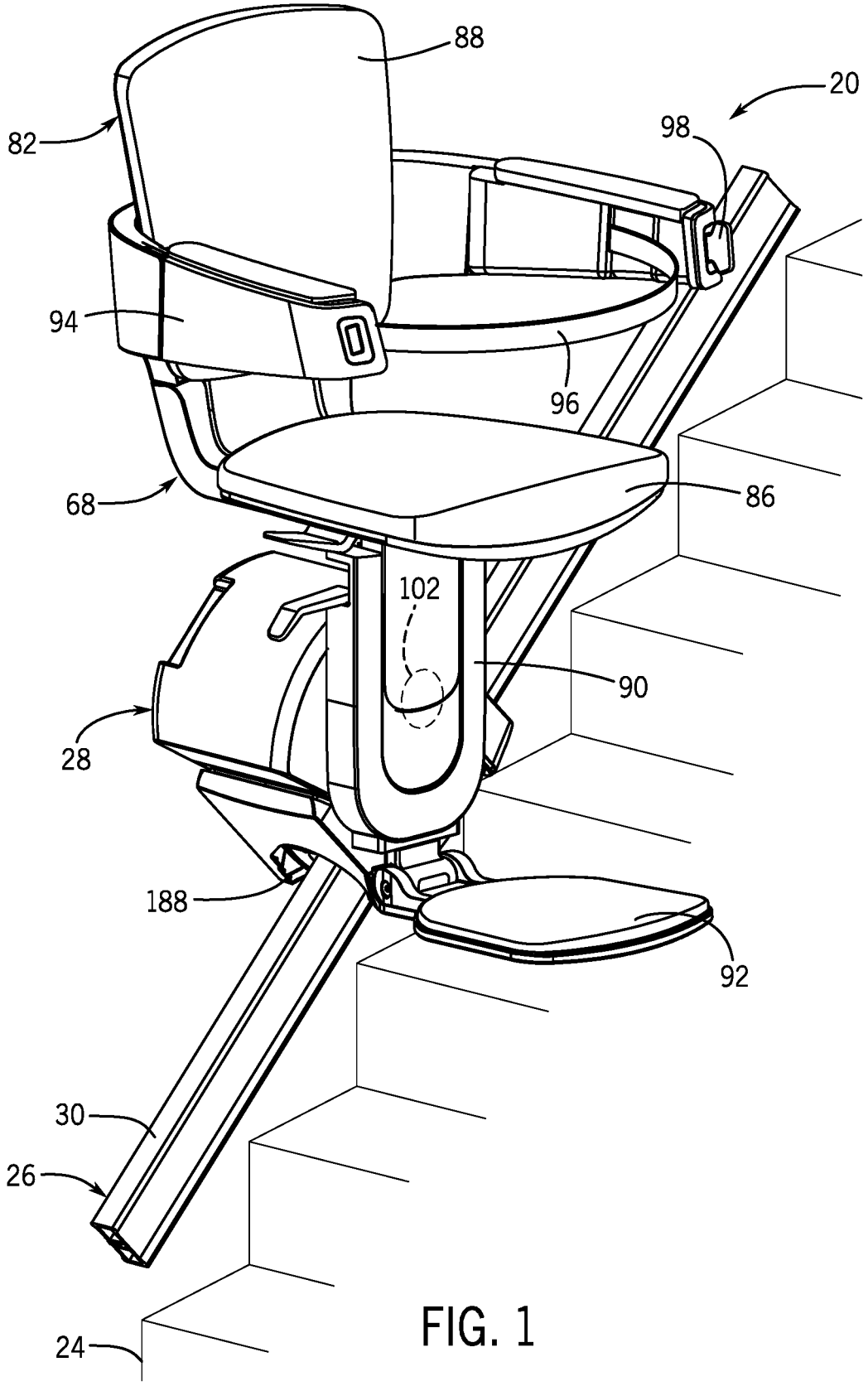
FIG. 1 illustrates a perspective view of a stairlift of the present disclosure mounted on a rail.
Figure 2:
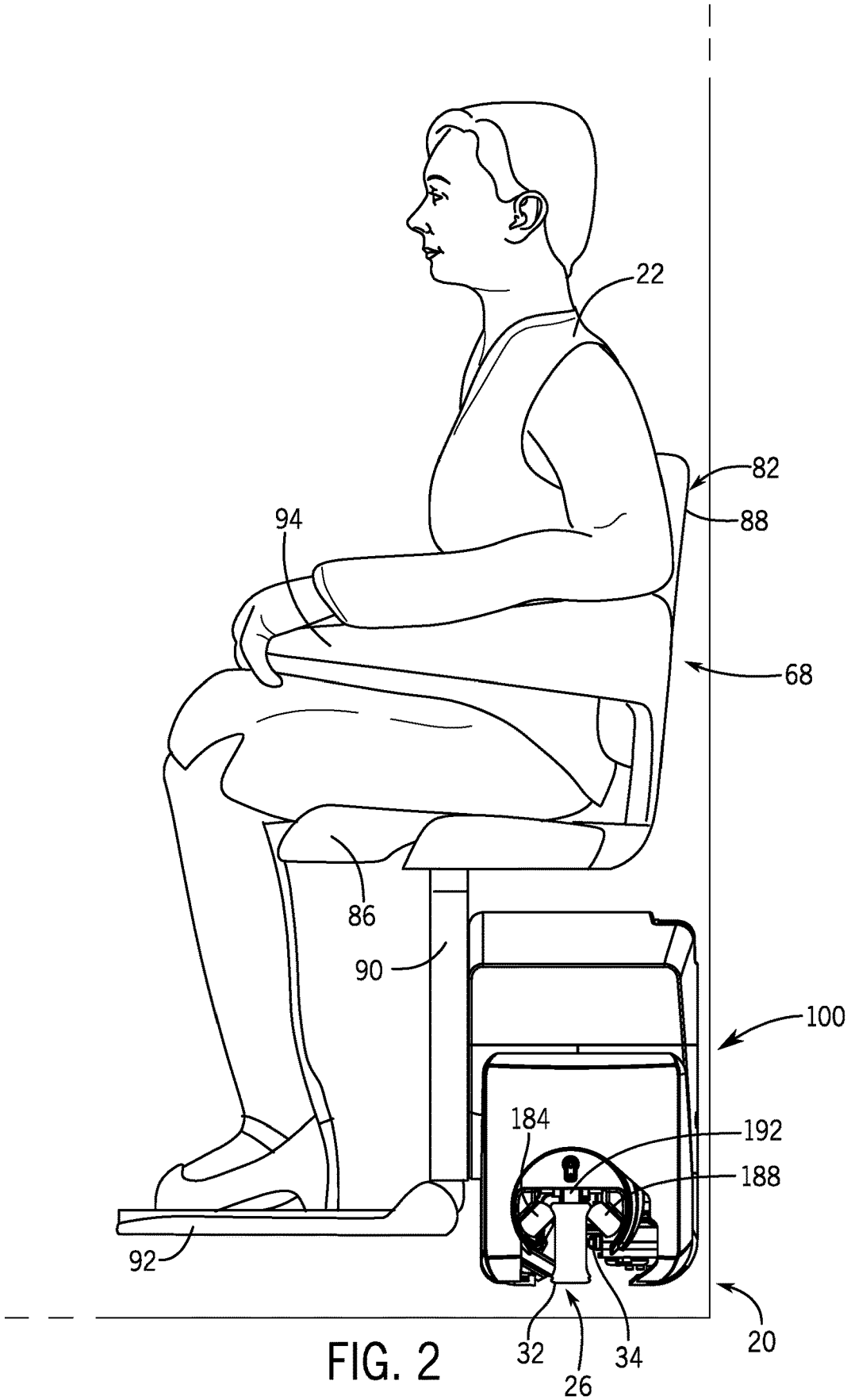
FIG. 2 illustrates an elevation view of the stairlift having a rider thereon and mounted on a rail.

While the disclosure may be susceptible to embodiment in different forms, there is shown in the drawings, and herein will be described in detail, a specific embodiment with the understanding that the present disclosure is to be considered an exemplification of the principles of the disclosure, and is not intended to limit the disclosure to that as illustrated and described herein. Therefore, unless otherwise noted, features disclosed herein may be combined together to form additional combinations that were not otherwise shown for purposes of brevity. It will be further appreciated that in some embodiments, one or more elements illustrated by way of example in a drawing(s) may be eliminated and/or substituted with alternative elements within the scope of the disclosure.

Definitions

The term "ball" means an article having an external surface having a spherical shape having a center, wherein the external surface has a spherical shape over a circumference greater than 180 degrees and at least 5 degrees, preferably at least 10 degrees, and more preferably at least 20 degrees, perpendicular to the circumference, wherein the degrees are measured from the center of the sphere. In a preferred embodiment, the ball has an opening passing completely through the spherical shape for accepting a portion of a rail and for providing rollers for engaging the rail. The opening preferably cuts through a portion of the circumference and the center of the spherical shape. The ball preferably has mounts for multiple rollers on the inside of the opening.

The term "socket" means an article having an internal surface having a spherical shape having a center, wherein the internal surface has a spherical shape over a circumference greater than 180 degrees and at least 5 degrees, preferably at least 10 degrees, and more preferably at least 20 degrees, perpendicular to the circumference, wherein the degrees are measured from the center of the sphere. The radius of the spherical shape is preferably only slightly greater than the radius of the spherical shape of the ball. In a preferred embodiment, the socket has an opening passing completely through the spherical shape. The opening preferably cuts through a portion of the circumference and the center of the spherical shape. The socket preferably comprises two components, each component adapted to be joined to the other component, preferably at or near a circumference greater than 180 degrees, to enclose the ball in the socket.

A stairlift 20 capable of conveying a load 22 along a stairway 24 or other travel path is provided. The stairlift 20, also referred to as a chair lift, stairway elevator, rail elevator, and other similar names, includes a low-profile rail 26 mounted along the stairway 24 or other travel path on which a carriage 28 operates to move the load 22. The load 22 may be, for example, an individual rider and/or cargo. The stairlift 20 provides smooth transitions through turns, curves, bends and other changes in the rail 26.

The rail 26 may include inclines, declines, various types of curves (including helical twists, turns and vertical elevation angle changes) and/or other changes in direction and/or orientation. Thus, various curves (helical, vertical, horizontal and combinations thereof) must be negotiated by the carriage 28. An angle change transitions the carriage 28 elevationally from one incline/decline angle to another. There are two types of angle changes—"going in" angle changes and "going out" angle changes. A "going in" angle change is an angle change that starts from a steeper angle and transitions to a flatter incline. A "going out" angle change is an angle change that starts from a lower degree and transitions to a higher degree incline. "Turns" transition the carriage 28 around a corner (horizontal bend) in a plan view. There are two primary types of turns and each primary type of turn has a corresponding secondary set. During an "inside turn" a rider's feet swing widely while the rider's back is closer to the turn's pivot point. In general, the rail 26 may be as close as possible to a wall to which the rail 26 is mounted to allow for maximum clearance for ambulatory people in the stairway 24 or other travel path. Inside turns often rotate the rider 90° or 180° in the plan view. A "helical turn" introduces an incline or elevation change while turning corners in connection with inside and outside turns (similar to a corkscrew or coil spring). A gooseneck or drop-nose configuration can also be provided which has a going in angle change, with an extremely steep start angle (e.g., vertical) that transitions to the incline of the stairway 24 or other travel path. The gooseneck or drop-nose configuration provides low a cargo carrying position height position relative to a floor at a base of the stairway 24 or other travel path, and a short extension away from a first step riser of the stairway 24 or other travel path.

Earlier systems allowed for "going in" angle changes of ~4°-30°, and "going out" angle changes of ~4°-30°. The stairlift 20 substantially expands the available ranges and allow for "going in" angle changes of ~4°-75° and for "going out" angle changes of ~4°-75°. Earlier systems allowed for elevation change for turns in the range of 0 to 0°-30°. The stairlift 20 increases the range of available elevational changes for turns to a range of ~0°-65°. The stairlift 20 provides for a gooseneck or drop-nose configuration having a starting incline angle ~60° and an exit angle range from ~20°-75°.

The rail 26 includes one or more rail segments 30 that fit within a given stairway 24 or other travel path. The one or more rail segments 30 can be straight, or can be curved in one or more ways, for example, being twisted, horizontally curved, vertically curved, and combinations thereof. Each rail segment 30 has a first end 30*a*, an opposite second end 30*a*, and a longitudinal central axis that extends between the ends 30*a*, 30*b*. A length of the rail segment 30 is defined between the ends 30*a*, 30*b*. When more than one rail segment 30 is provided, the rails segments 30 are connected at adjacent ends 30*a*, 30*b* at a joint (not shown) which may be formed of an internal bracket connecting the rail segments 30 together.

The figures show an example rail segment 30 which may be used as part of the stairlift 20. The rail segment 30 includes an elongated tube 32 and an elongated rack 34 on the tube 32. In an embodiment, the rack 34 is separately formed from the tube 32 and attached thereto.

The tube 32 is formed from a durable, yet suitably malleable material. In some implementations, the tube 32 is formed from aluminum or an aluminum alloy.

Figure 3:
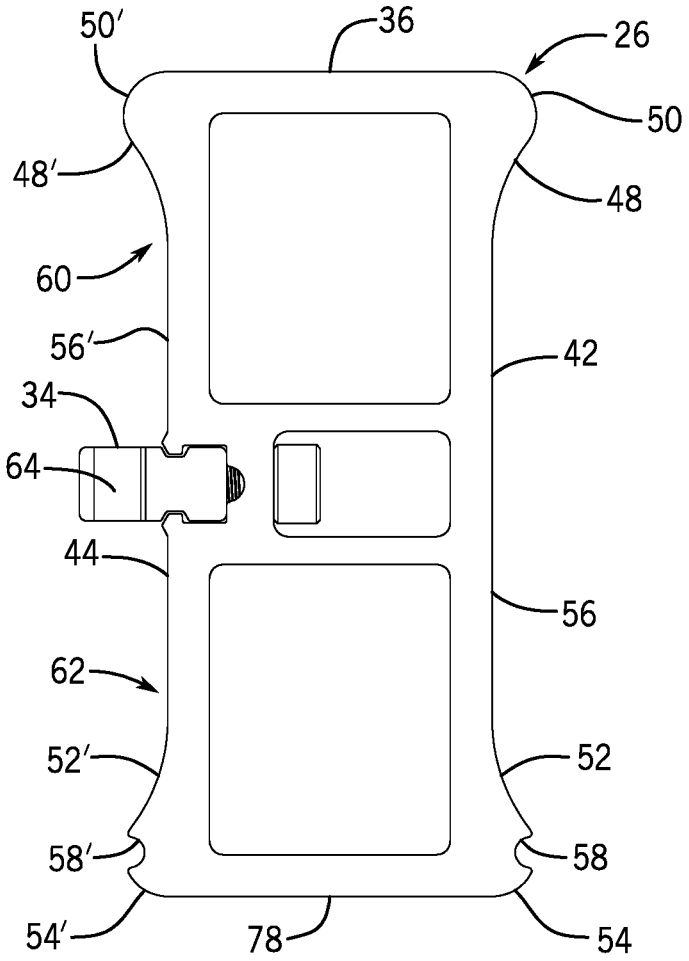
FIG. 3 illustrates a cross-sectional view of the rail.

When the tube 32 is in an unbent condition or untwisted condition, the tube 32 has a constant cross-sectional shape along its length from a first end 32*a* to a second end 32*b* thereof. In the unbent condition or untwisted condition, the tube 32 generally is a parallelogram. In an embodiment, the tube 32 has generally rectangular cross-sectional shape or an hourglass cross-sectional shape, as shown in FIG. 3. By generally, it is meant that not all of the sides are linear.

The following cross-sectional shape is described when the tube 32 is in the unbent condition and untwisted condition as shown in FIG. 3. The tube 32 has a planar top surface 36 forming a first roller engagement surface and a bottom surface 38. In an embodiment, the bottom surface 38 is planar and is parallel to the top surface 36. An outer side surface 42 extends between the top and bottom surfaces 36, 38 and faces away from the wall when the rail segment 30 is mounted on the wall. An inner side surface 44 extends between the top and bottom surfaces 36, 38 and faces the wall when the rail segment 30 is mounted on the wall. A centerline 46 is defined between the top and bottom surfaces 36, 38 and splits the tube 32 into halves with the outer side surface 42 on one side of the centerline 46 and the inner side surface 44 on the other side of the centerline 46.

The outer side surface 42 has a curved surface 48 which extends along a radius line, an upper curved surface 50 that extends between an upper end of the curved surface 48 and the top surface 36, a curved surface 52 which extends along a radius line, a lower curved surface 54 that extends between a lower end of the curved surface 52 and the bottom surface 38, and a planar surface 56 which extends between a lower end of the surface 48 and an upper end of the curved surface 52. The curved surfaces 48, 52 may have the same radius. The surface 48 provides a second roller engagement surface. The curved surface 52 provides a third roller engagement surface. A groove 58 may be formed in the lower curved surface 54 and extends longitudinally along the rail segment 30 to permit mounting of the rail segment 30 on the stairway 24 or other travel path using a suitable mount (not shown), such as a cleat and mounting bracket.

In an embodiment, the inner side surface 44 is the mirror image of the outer side surface 42 with the exception of the rack 34 that interrupts the planar surface 56 and extends longitudinally on the tube 32. As such, like elements on the inner side surface 44 are shown with like reference numerals, except with a prime after the reference numeral. The rack 34 divides the inner side surface 44 into an upper portion 60 and a lower portion 62. The curved surface 48' provides a fourth roller engagement surface. The surface 56' provides a fifth roller engagement surface. In an embodiment, the surface 56' in the upper portion 60 provides the fifth roller engagement. In an embodiment, the surface 56' in the lower portion 62 provides the fifth roller engagement. In an embodiment, any surface of the tube 32 that does not form a roller engagement surface can take shapes other than those specifically shown.

The rack 34 has a plurality of spaced apart teeth 64 which extend outwardly from the surface 56'. In an embodiment, the rack 34 is at the midpoint of the inner side surface 44. The rack 34 is formed from a durable material. In an embodiment, the rack 34 is integrally formed with the tube 32. In an embodiment, the rack 34 and the tube 32 are separately formed, the rack 34 and the tube 32 are secured together, and the rack 34 may be made of a more rigid material from that which the tube 32 is formed, but in some embodiments, is more robust than the tube 32. In some embodiments, the rack 34 is formed from steel.

The generally hourglass cross-section of the rail 26 provides a stable base on which carriage 28 operates. The generally hourglass cross-section shape of the rail 26 provides inherent torsional resistance because of its shape when compared to round tube systems, which need additional parts (for example, welded guides for the entire length of the rail 26) to take up the torsion in the system, resulting in larger beams (which can occupy valuable space in staircases and other installation locations).

The carriage 28 includes a frame 66, a load support assembly 68 mounted on the frame 66 and which carries the load 22 along the stairway 24 or other travel path, and a rail-engaging drive apparatus 70 mounted on the frame 66 and which is engaged with the rail 26. In some of the drawings, the carriage 28 is partially covered by a shroud to protect the internal components. For ease in description, the structure of the carriage 28 is described in a position where the carriage 28 is attached to a horizontally extending straight portion of the rail 26.

The frame 66 includes a horizontally extending base portion 72, a first mounting portion 74 extending vertically upward from a first side of the base portion 72, and a second mounting portion 76 extending vertically downward from the first side of the base portion 72, and a third mounting portion 78 extending horizontally outwardly from a second side of the base portion 72. A longitudinally extending centerline 80 of the frame 66 extends from a front end of the base portion 72 to a rear end of the base portion 72. The first and second mounting portions 74, 76 are on a first side of the centerline 80 and are on the side of the carriage 28 which faces away from the wall when the stairlift 20 is mounted to the wall, and the third mounting portion 78 is on the second side of the centerline 80 and on the side of the carriage 28 which faces the wall when the stairlift 20 is mounted to the wall.

In an embodiment, and as shown in the drawings, the load support assembly 68 includes a load support 82 for supporting the load 22, and a support-leveling mechanism 84 which attaches the load 22 to the first mounting portion 74 of the frame 66. The support-leveling mechanism 84 is further used to rotate the load support 82 about a horizontal axis relative to the frame 66 to maintain the load 22 in an upright position as the carriage 28 traverses along the rail 26.

In the embodiment shown, the load support 82 is a chair which includes a seat 86, a backrest 88 extending from the seat 86, a chair plate 90 extending downwardly from the seat 86, a footrest 92 extending from a bottom of the chair plate 90, and foldable armrests 94 and a safety belt 96 attached to the backrest 88. Control buttons 98, may be provided on one of the armrests 94 to allow a rider to operate the stairlift 20 when seated on the load support 82.

Figure 4:
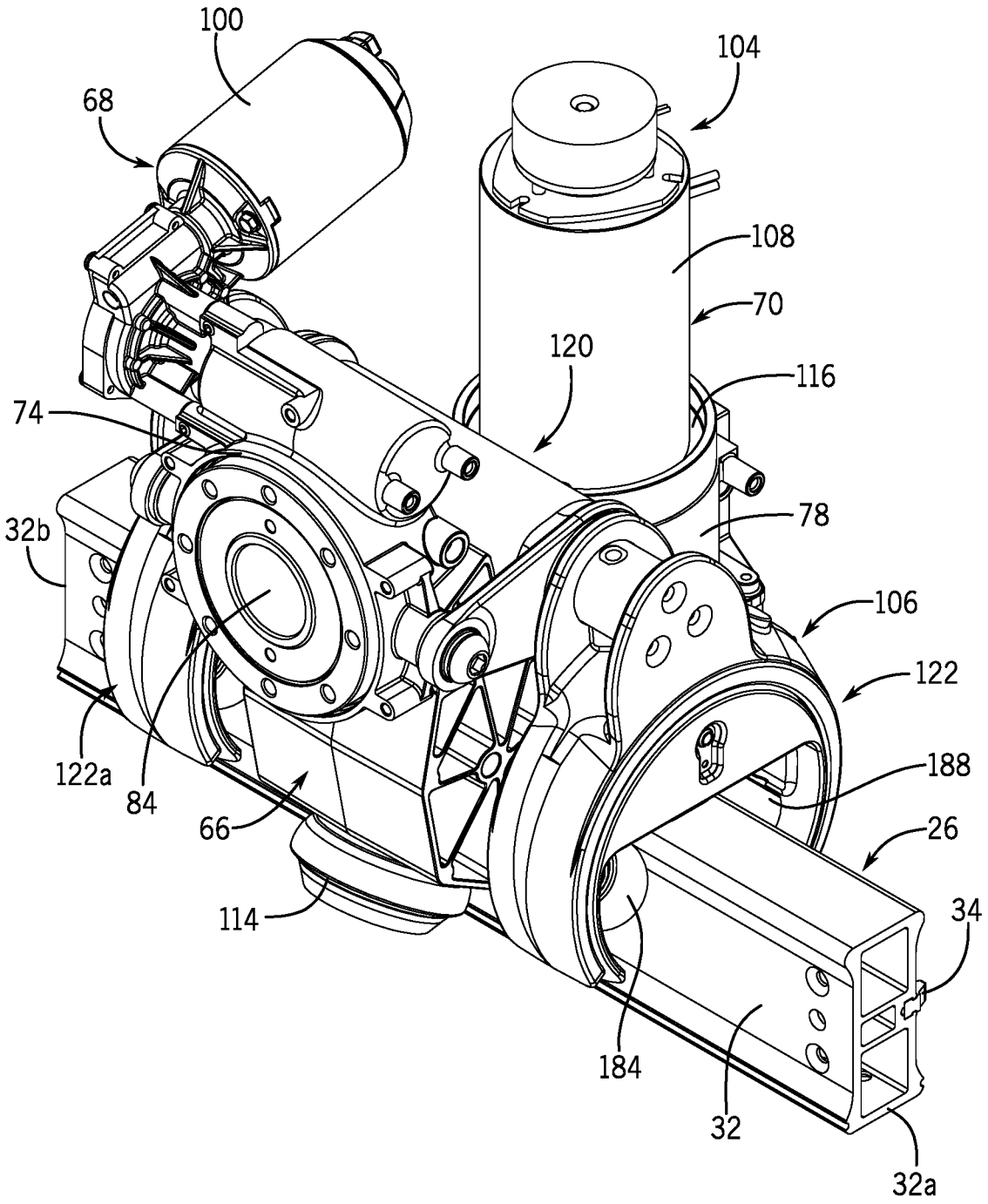
FIG. 4 illustrates a perspective view of components of the stairlift mounted on the rail.

The support-leveling mechanism 84 includes a motor 100, see FIG. 4, attached to the first mounting portion 74 of the frame 66 and a rotator 102, see FIG. 1, operatively connected to the motor 100 and rotatably mounted on the first mounting portion 74 of the frame 66. The motor 100 is operatively connected to the load support 82 via the rotator 102. In an embodiment, the rotator 102 is attached to the chair plate 90. As an example, the support-leveling mechanism 84 rotates the load support 82 such the seat 86 is always in the horizontal plane.

The rail-engaging drive apparatus 70 includes a central drive unit 104 attached to the frame 66, and a bogie assembly 106 attached to the frame 66 and mounted on the rail 26. The rail-engaging drive apparatus 70 provides a stable ride for the carriage 28 as the carriage 28 travels along the rail 26.

Figure 6:
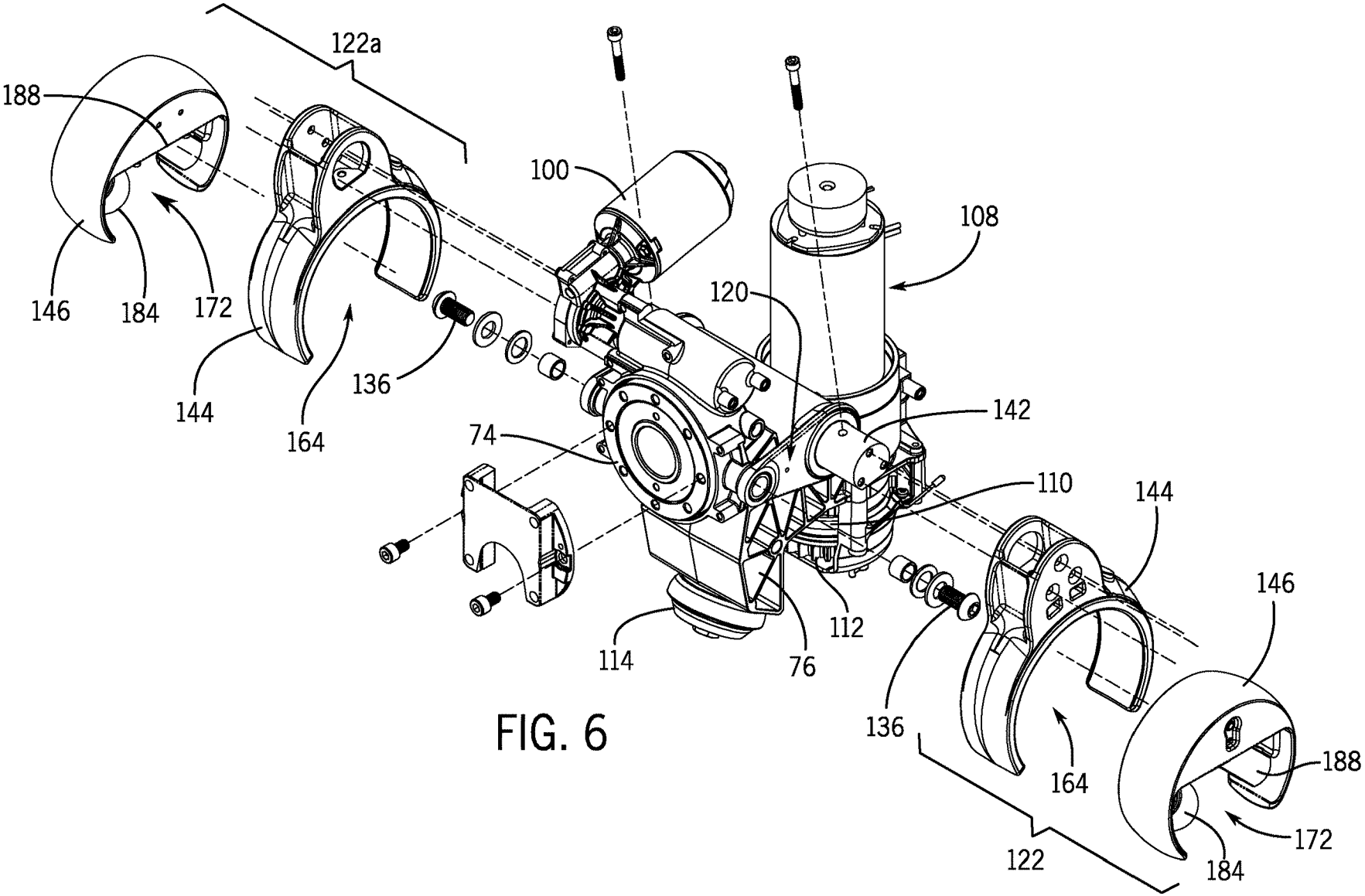
FIG. 6 illustrates an exploded, perspective view of components of the stairlift.
Figure 7:
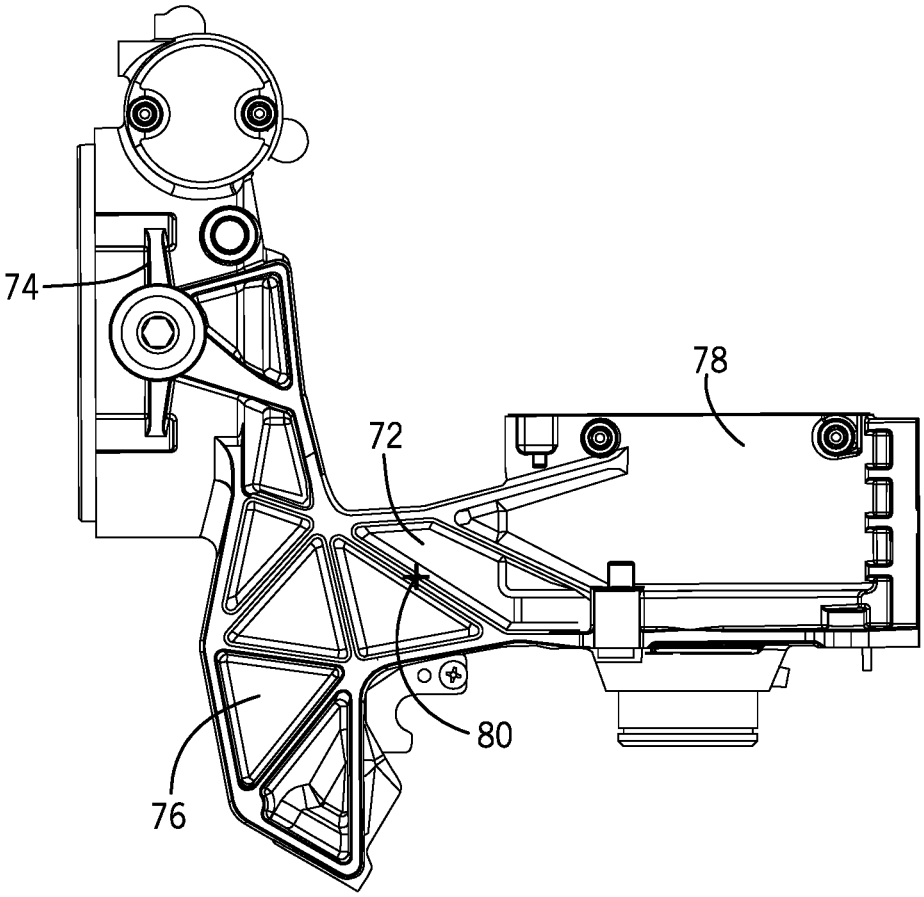
FIG. 7 illustrates an elevation view of components of the stairlift.
Figure 8:
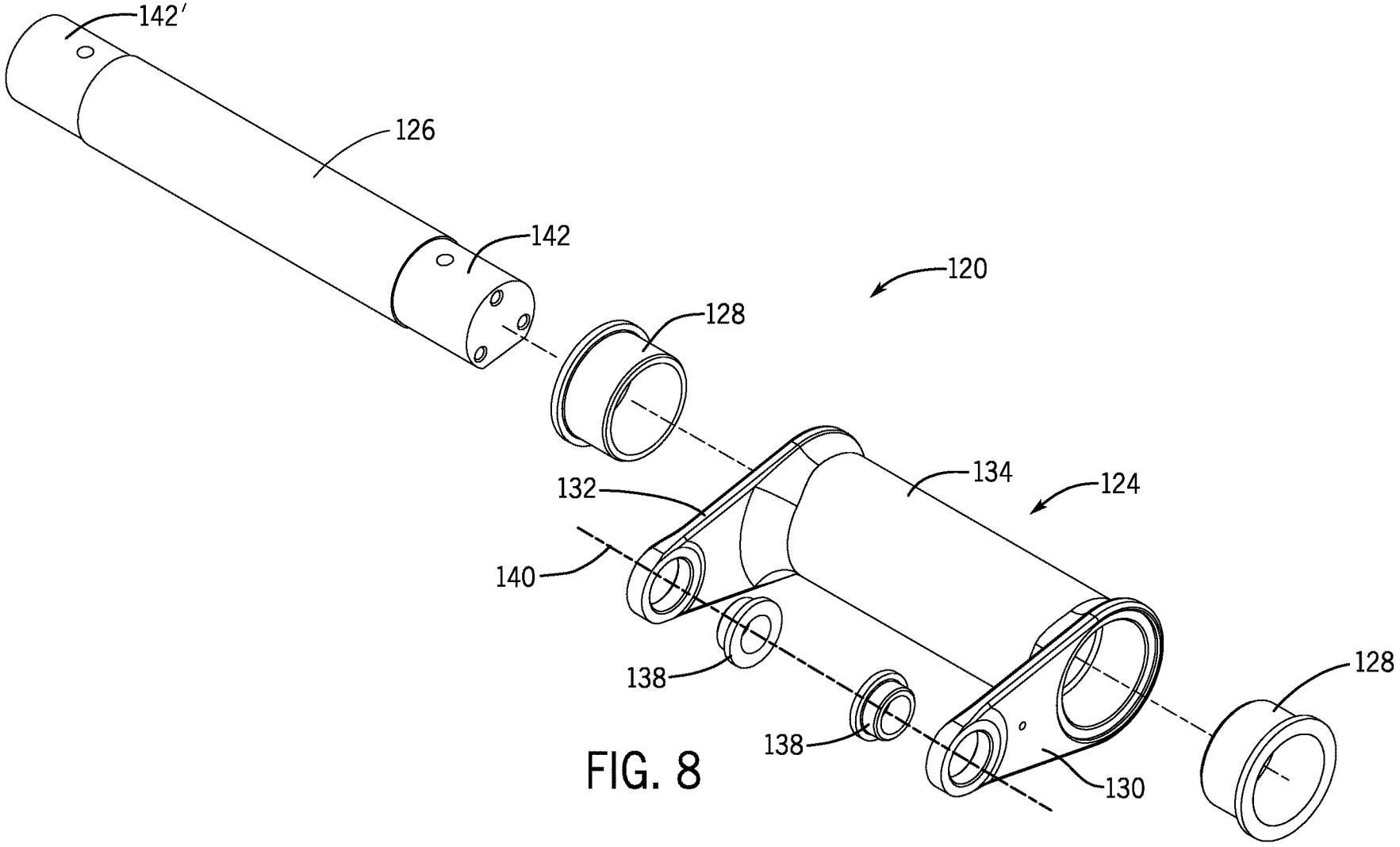
FIG. 8 illustrates an exploded, perspective view of a yoke assembly of the stairlift.

The central drive unit 104, as shown in FIG. 6, includes a main drive motor 108 attached to the third mounting portion 78, an over speed gear roller (OSG roller) 110 fixedly mounted on a drive shaft of the main drive motor 108, a drive gear 112 fixedly mounted on the drive shaft of the main drive motor 108, and an overhung load roller (OHL roller) 114 rotatably mounted on the second mounting portion 76 of the frame 66. The drive shaft of the main drive motor 108 extends vertically downward from the third mounting portion 78 such that its axis of rotation is perpendicular to the centerline 80 of the frame 66. In an embodiment, the third mounting portion 78 has a vertically extending passageway 116 in which the main drive motor 108 seats, with the drive shaft of the main drive motor 108 extending through a reduced diameter section of the passageway 116.

The OSG roller 110 has a cylindrical outer profile. When the main drive motor 108 is actuated, the OSG roller 110 also rotates. As shown, the OSG roller 110 is mounted above the drive gear 112; however, the OSG roller 110 may instead be mounted below the drive gear 112, or an upper OSG roller 110 may be mounted above the drive gear 112 and a lower OSG roller 110 may be mounted below the drive gear 112.

The OHL roller 114 is rotatably mounted on an angled wall 118 at a lower end of the second mounting portion 76. The OHL roller 114 has an axis of rotation which is angled relative to the centerline 80 of the frame 66. The OHL roller 114 has an outer profile which is radiused to match the profile of the curved surface 52.

The bogie assembly 106 includes a yoke assembly 120 pivotally attached to the first mounting portion 74 of the frame 66, a first bogie unit 122 fixedly mounted to the yoke assembly 120, and a second bogie unit 122*a* fixedly mounted to the yoke assembly 120.

The yoke assembly 120 includes a rigid yoke 124 pivotally attached to the first mounting portion 74 of the frame 66, and a yoke shaft 126 mounted in the yoke 124 by a plurality of bushings 128. The yoke shaft 126 is therefore rotatable relative to the yoke 124 and rotatable relative to the frame 66.

Figure 9:
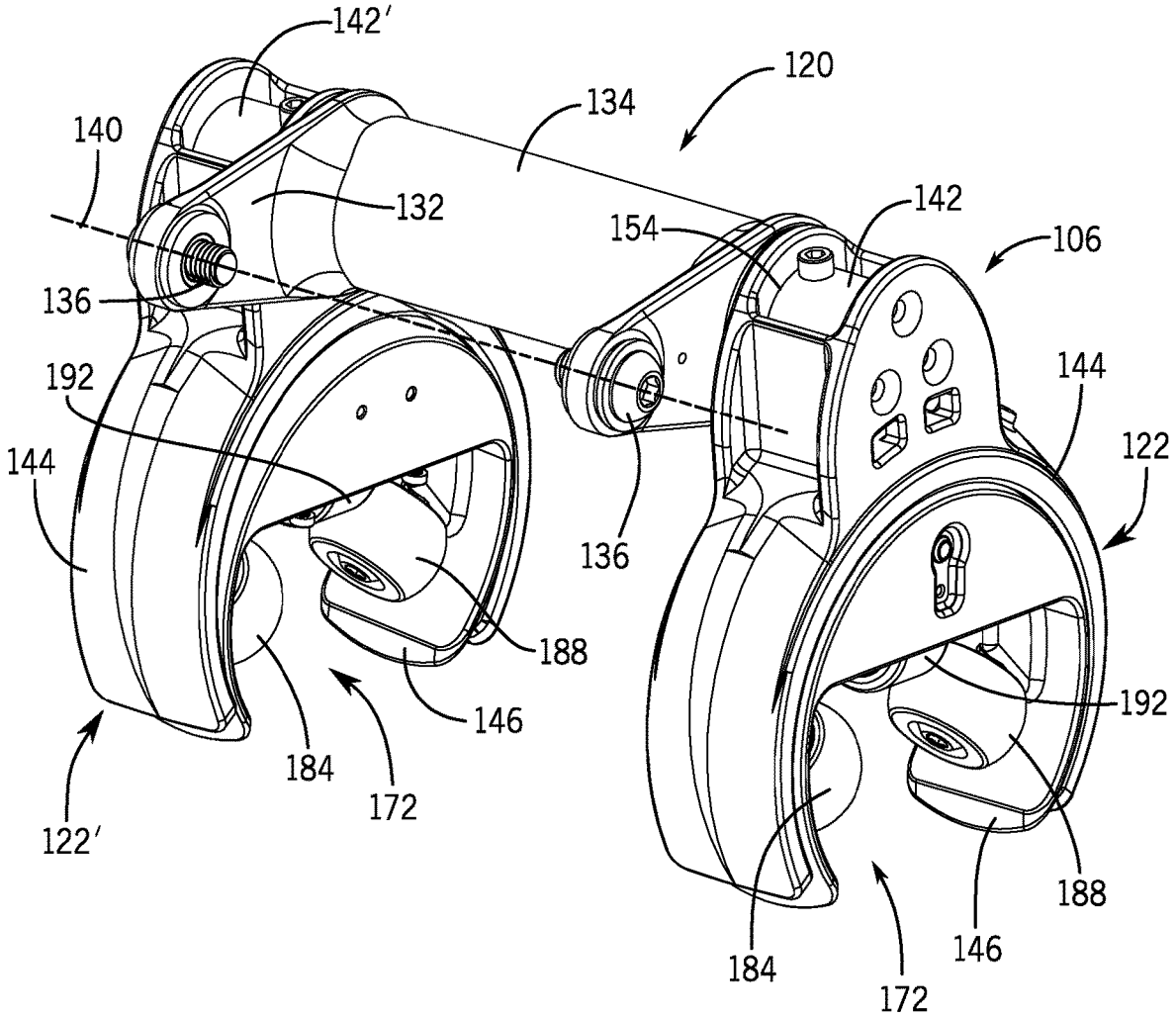
FIG. 9 illustrates a perspective view of the yoke assembly and bogie assemblies of the stairlift.

The yoke 124 has a first arm 130 having a first end pivotally attached to the first mounting portion 74 at a front end thereof, and extending horizontally from the first mounting portion 74 and parallel to the base portion 72, a second arm 132 having a first end pivotally attached to the first mounting portion 74 at a rear end thereof, and extending horizontally from the first mounting portion 74 and parallel to the base portion 72, and a sleeve 134 extending horizontally between second ends of the first and second arms 130, 132. The arms 130, 132 have parallel extending longitudinal axes. The sleeve 134 is parallel to the centerline. The arm 130, 132 are pivotably connected to the first mounting portion 74, for example, by two pivot bolts 136 that restrict all motion except for rotation using two bushing 138 about axis 140 in FIG. 9.

The yoke shaft 126 is mounted in the sleeve 134 and has end portions 142, 142' which extend outwardly from the sleeve 134. The bushings 128 are provided between the yoke shaft 126 and the sleeve 134 to allow the yoke shaft 126 to rotate relative to the sleeve 134. The bogie units 122, 122*a* are fixedly attached to the respective end portions 142, 142' to rotate both bogie units 122, 122*a* in unison relative to the frame 66.

The bogie units 122, 122*a* provide needed degrees of freedom to maintain support of the carriage 28 on the rail 26 while being able to traverse through all types of rail bend possibilities in a simple and compact manner. One bogie unit 122 is described with the understanding that the other bogie unit 122*a* is identically formed. The bogie unit 122 includes a bogie socket 144, a bogie ball 146 mounted in the bogie socket 144, and a plurality of rollers 184, 188, 192 mounted on the bogie ball 146.

The bogie socket 144 is fixedly attached to the yoke shaft 126 at a mount 156 which may be integrally formed with the bogie socket 144 or with the yoke shaft 126. In an embodiment, the end portion 142 of the yoke shaft 126 passes through an opening in the mount 156 and is affixed thereto by fasteners, and the end portion 142 of the yoke shaft 126 has a flat surface which engages with a flat surface on the mount 156. Other structures for fixedly attaching the yoke shaft 126 and the bogie socket 144 may be provided.

Figure 10:
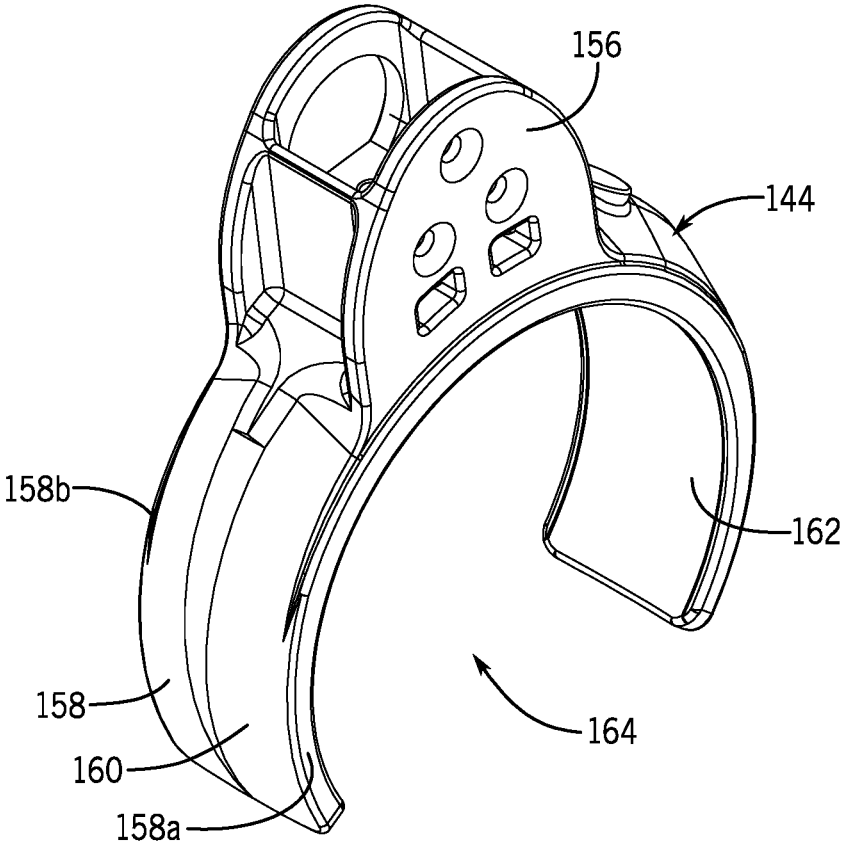
FIG. 10 illustrates a perspective view of a bogie socket of the bogie assemblies.

The bogie socket 144 has a bottom open ended housing 158 which extends downwardly from the mount 156. As best shown in FIG. 10, the housing 158 has a front end 158*a*, an opposite rear end 158*b*, an exterior surface 160 extending between the front and rear ends 158*a*, 158*b*, and an interior surface 162 extending between the front and rear ends 158*a*, 158*b* and which defines a passageway 164 that is open to a bottom end of the housing 158. A length of the housing 158 is defined between the front and rear ends 158*a*, 158*b*. The passageway 164 has an opening at the front end 158*a* which is semi-circular, an opening at the rear end 158*b* which is semi-circular, and an intermediate portion therebetween which is partially spherical. The housing 158 forms a socket in which the bogie ball 146 is seated.

Figure 11:
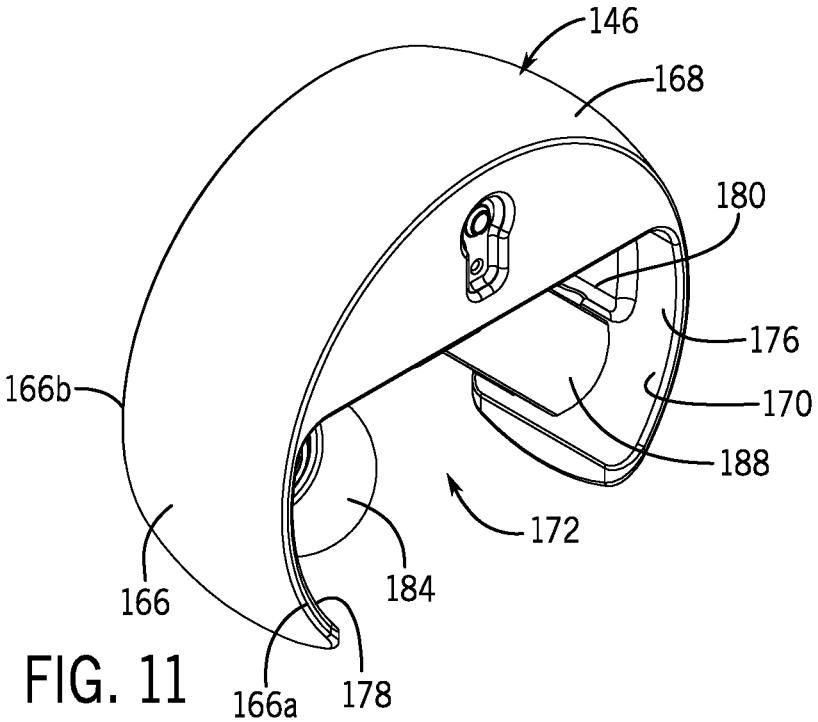
FIG. 11 illustrates a perspective view of a bogie ball of the bogie assemblies.
Figure 12:
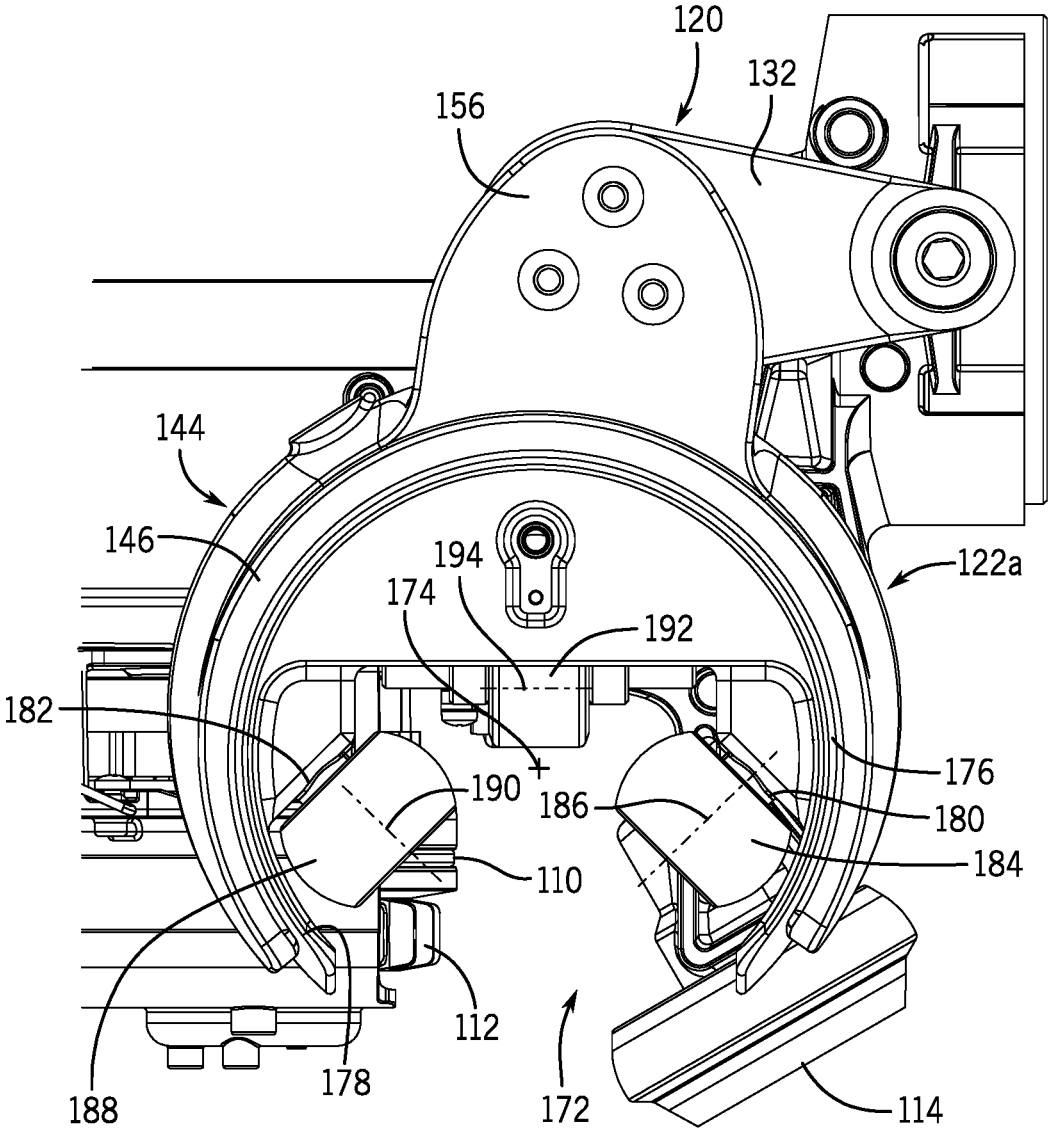
FIG. 12 illustrates an elevation view of the yoke assembly and one of the bogie assemblies.
Figure 13:
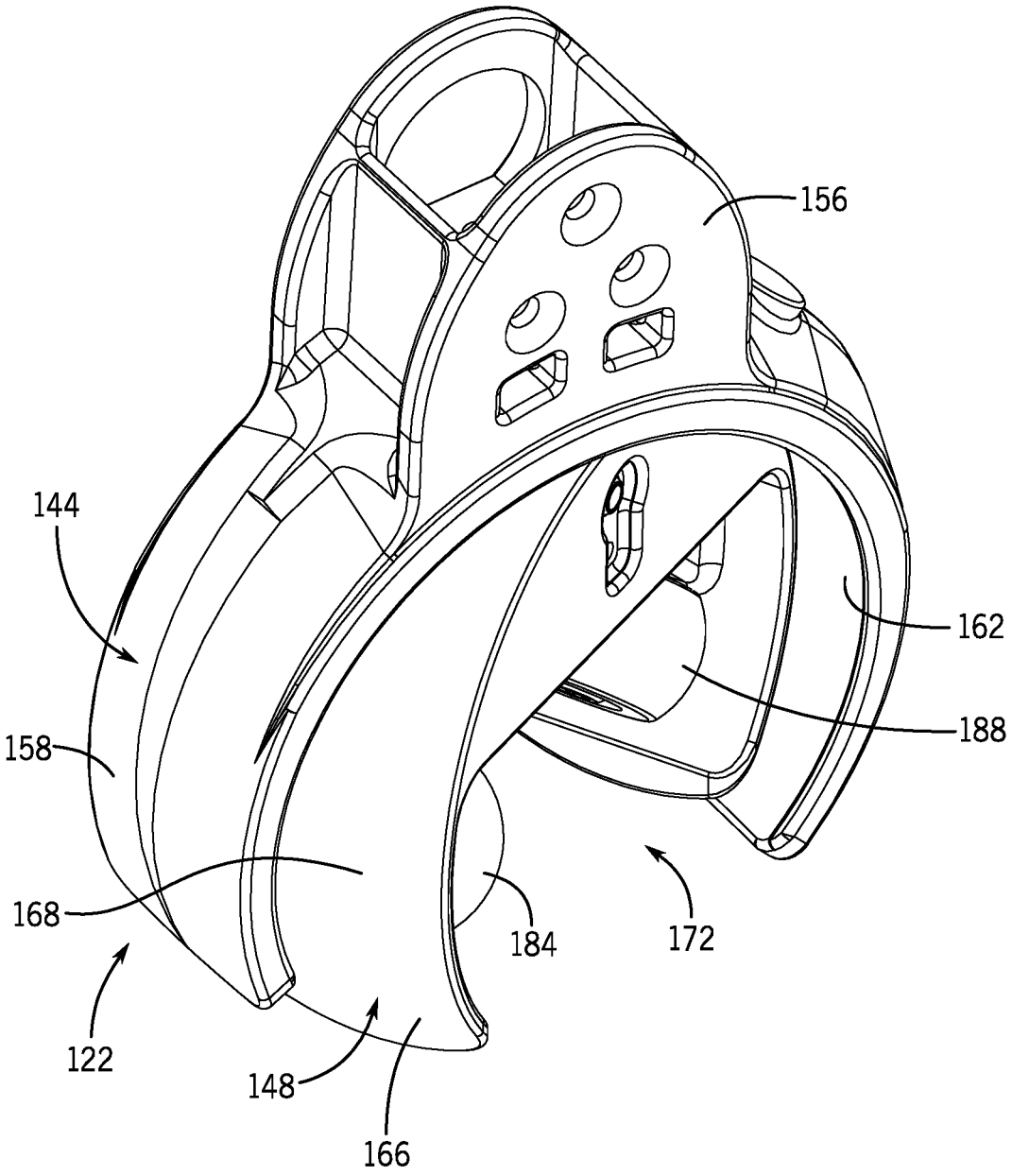
FIG. 13 illustrates a perspective view of an assembled bogie socket and bogie ball.
Figure 14:
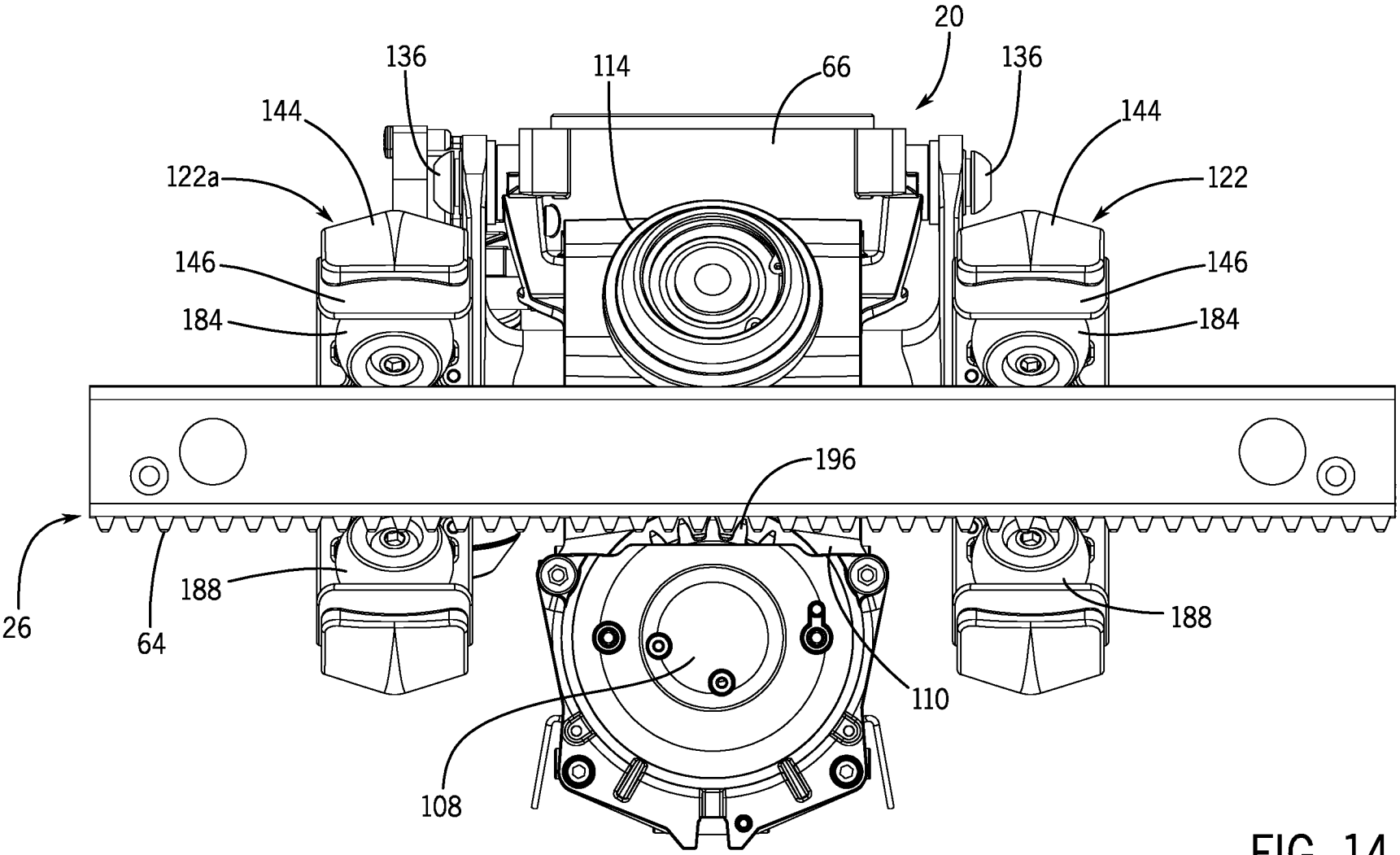
FIG. 14 illustrates a bottom plan view of the rail and the stairlift, without a seat.

The bogie ball 146 is formed of a bottom open ended housing 166 having a front end 166*a*, an opposite rear end 166*b*, an exterior surface 168 extending between the front and rear ends 166*a*, 166*b*, and an interior surface 170 extending between the front and rear ends 166*a*, 166*b* and which defines a passageway 172 that is open to a bottom end of the housing 166, as best shown in FIG. 11. A length of the housing 166 is defined between the front and rear ends 166*a*, 166*b*.

The exterior surface 168 has a partial spherical shape and conforms to the shape of the interior surface 162 of the bogie socket 144. A longitudinal axis 174 of the housing 166 is defined between the front and rear ends 166*a*, 166*b* and the center of the sphere which forms the partial spherical shape of the exterior surface 168 falls on the longitudinal axis 174. The length of the housing 166 of the bogie ball 146 is greater than the length of the housing 158 of the bogie socket 144 such that a desired spherical rotation movement of the bogie ball 146 within the bogie socket 144 is achieved, depending on the range of free rotation required, while retaining the bogie ball 146 within the bogie socket 144 during normal operation.

The passageway 172 has first and second side walls 176, 178 extending from the front end 166*a* to the rear end 166*b* and extending from the bottom of the open-ended housing 166 to a top wall (not shown). Each side wall 176, 178 is curved. The top wall may be planar and extends between the front and rear ends 166*a*, 166*b*. A first angled wall 180 extends between the first side wall 176 and the top wall, and a second angled wall 182 extends between the second side wall 178 and the top wall. The first and second angled walls 180, 182 extend along only a portion of the length of the housing 166.

A first bogie roller 184 having a spherical outer profile is rotatably mounted to the first angled wall 180, with its axis of rotation 186 being angled relative to the longitudinal axis 174 of the housing 166. A second bogie roller 188 having a spherical outer profile is rotatably mounted to the second angled wall 182, with its axis of rotation 190 being angled relative to the longitudinal axis 174 of the housing 166 and angled relative to the axis of rotation 186 of the first bogie roller 184. A third bogie roller 192 has a cylindrical outer profile, is rotatably mounted to the top wall and has an axis of rotation 194 which is perpendicular to the longitudinal axis 174 of the housing 166. The third bogie roller 192 can be spring loaded mounted to the top wall.

The bogie ball 146 seats within the passageway 164 of the bogie socket 144 such that a portion of the exterior surface 168 of the bogie ball 146 is contact with the interior surface 162 of the bogie socket 144 at all times during operation. The bogie ball 146 is rotatable and pivotable relative to the bogie socket 144 to provide multiple degrees of freedom for the bogie ball 146 to move relative to the bogie socket 144.

The bogie units 122, 122*a* are fixedly mounted to the end portions 142, 142' of the yoke shaft 126 of the rotatable yoke assembly 120 and afford an infinite number of axes of rotation to provide for a highly flexible and adaptable engagement and movement of the bogie units 122, 122*a* relative to the rail 26. Each bogie unit 122, 122*a* permits spherical pivoting of the bogie unit 122, 122*a* relative to the rail 26. The yoke assembly 120 permits pivoting of the bogie unit 122, 122*a* relative to the rail 26. The yoke assembly 120, in combination with the bogie sockets 144 and the bogie balls 146, provide for a simple, reliable and highly adaptable spherical rotation structure that can perform and/or complete all required motions while maintaining carriage 28 on the rail 26. This capability makes this configuration appropriate for adapting this carriage-rail linkage system to a single generally rectangular rail 26. The yoke assembly 120 and the bogie units 122, 122*a* allow the carriage 28 to continuously adjust in three dimensions while making turns and/or angle changes in all directions. The spherical pivoting of each bogie ball 146 is unlimited with regard to axis or direction of rotation.

In use, the rollers 184, 188, 192 engage and partially surround the rail 26 and assist in steering the bogie units 122, 122*a* through rail turns, curves, angular changes and/or other transitions. The central drive unit 104 and the bogie units 122, 122*a* directly engage the rail 26 and provide reactive forces and moments that handle linear forces and rotational moments imposed on the carriage 28 throughout its rail-defined travel path, including when the load 22 is being transported.

Figure 5:
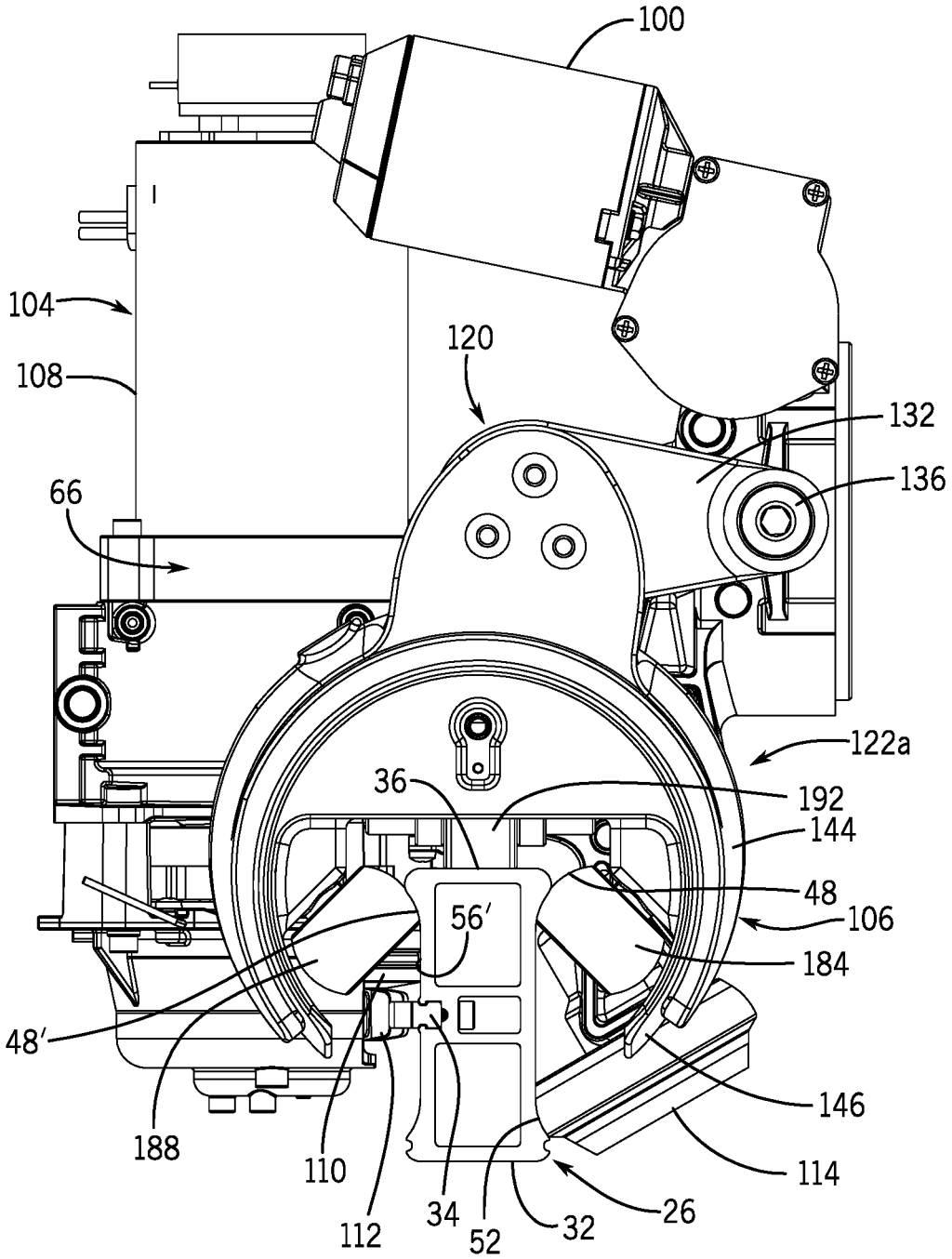
FIG. 5 illustrates an elevation view of components of the stairlift mounted on the rail.
Figure 15:
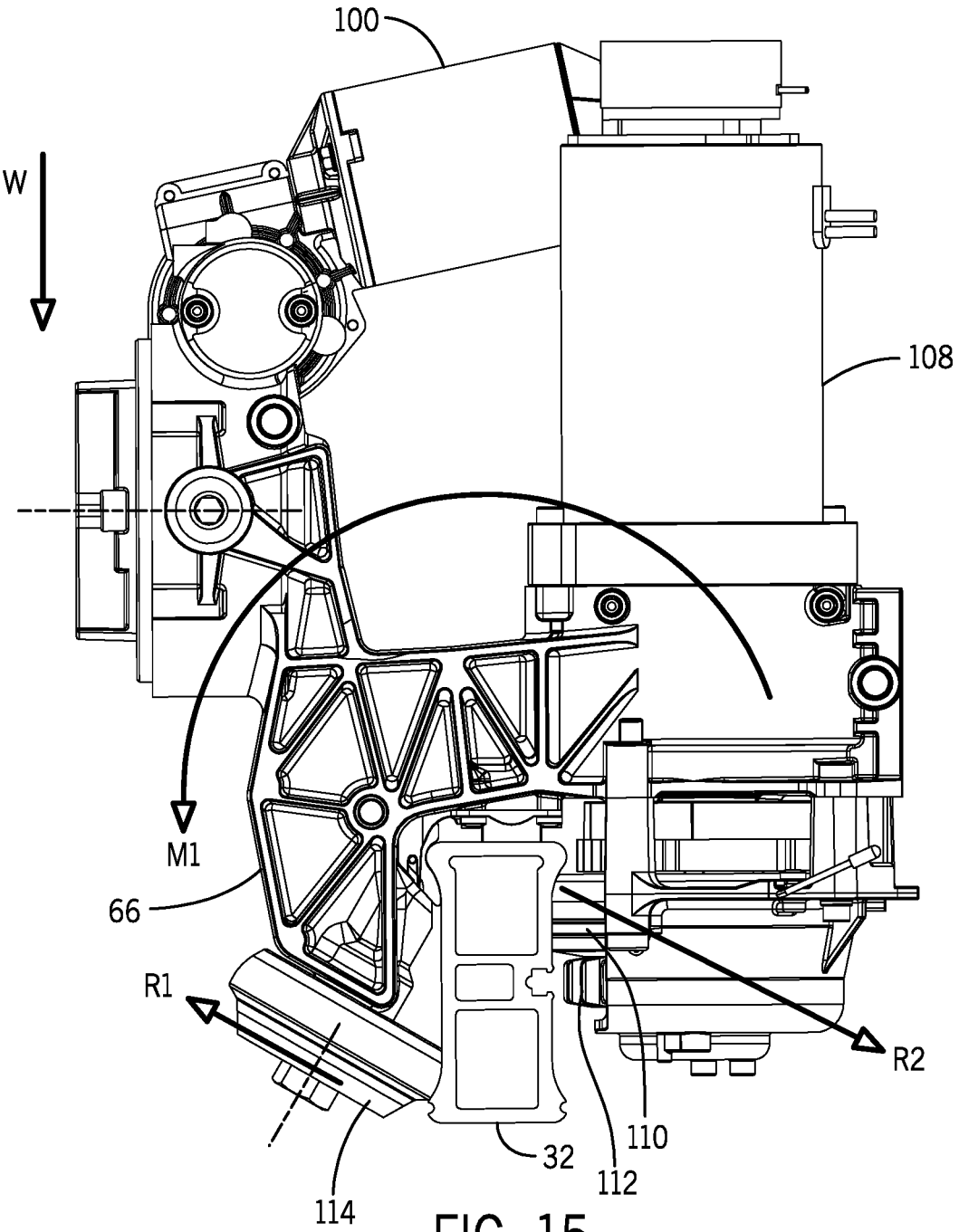
FIG. 15 illustrates an elevation view of components of the stairlift and a cross-section view of the rail, showing forces acting thereon.

When the carriage 28 is positioned on the rail 26, the frame 66 seats over the rail 26 such that the base portion 72 spans the top of the rail 26, the first mounting portion 74 extends upwardly from the rail 26 above surface 48, the second mounting portion 76 extends downwardly from the rail 26 proximate to the curved surface 52, and the third mounting portion 78 extends downwardly from the rail 26 proximate to the curved surface 52'. Teeth 196 on the drive gear 112 interengage with the teeth 64 on the rack 34 of the rail 26, the OSG roller 110 engages with the planar surface 56' of the rail 26, and the OHL roller 114 engages the curved surface 52, as seen in FIG. 5. When the main drive motor 108 is actuated, the drive gear 112 rotates and causes the carriage 28 to be moved along the rail 26. This contact of the drive gear 112 with the teeth 64 on the rack 34, the contact of the OSG roller 110 with the planar surface 56' of the rail 26, and the contact of the OHL roller 114 with the curved surface 52 is maintained throughout the traversal of the carriage 28 along the rail 26. The yoke assembly 120 handles the linear load component, force Fx, that is parallel to the rail 26 in FIG. 15, as well as the M1 moment load also shown in FIG. 15. FIG. 15 also illustrates how components of the yoke assembly 120 provide reactive offsets to the load-induced linear and rotational forces in the rail 26. The moment load M1 caused by the offset of the load W (load 22) relative to the rail 26 is counteracted by the reactive forces R1 and R2 in FIG. 15. Thus, the linear and rotational/moment components of a supported load 22 can be balanced by the support-leveling mechanism 84 and the yoke assembly 120 to maintain the load 22 in an upright position when either stationary or moving in the desired direction on the rail 26.

The rail 26 seats within the passageways 172 of the bogie units 122, 122*a*. In each bogie unit 122, 122*a*, the cylindrical roller 192 engages the planar top surface 36 of the rail 26 as shown in FIG. 5 and counters the M2 moment's resulting force −R3, see FIG. 16, when the bogie unit 300 is in an "uphill" orientation relative to the frame 66. In each bogie unit 122, 122*a*, the rollers 184, 188 engage curved surfaces 48, 48' as shown in FIG. 5, which curved surfaces 48, 48' are radiused at a corresponding radii to that of the spherical surface outer profiles of the rollers 184, 188. The spherical surface of each roller 184, 188 contacts the curved surfaces 48, 48' and counter the M2 moment's resulting force +R3, see FIG. 16, when the respective bogie unit 122, 122*a* is in a "downhill" orientation relative to the frame 66. By effectively enclosing the upper portion of rail 26, the bogie units 122, 122*a* keep the carriage 28 engaged with the rail 26, while carriage 28 reacts to the forces generated in connection with the moment M2 of FIG. 16. The spherical surfaces of the rollers 184, 188, along with the top roller 192, steer and/or guide carriage 28 as the rail 26 incrementally changes directions in a turn, curve, angular change and/or other transition.

The profile of the rail 26 manages all the forces applied by the stairlift 20, with the exception of the driving or lifting force.

Figure 16:
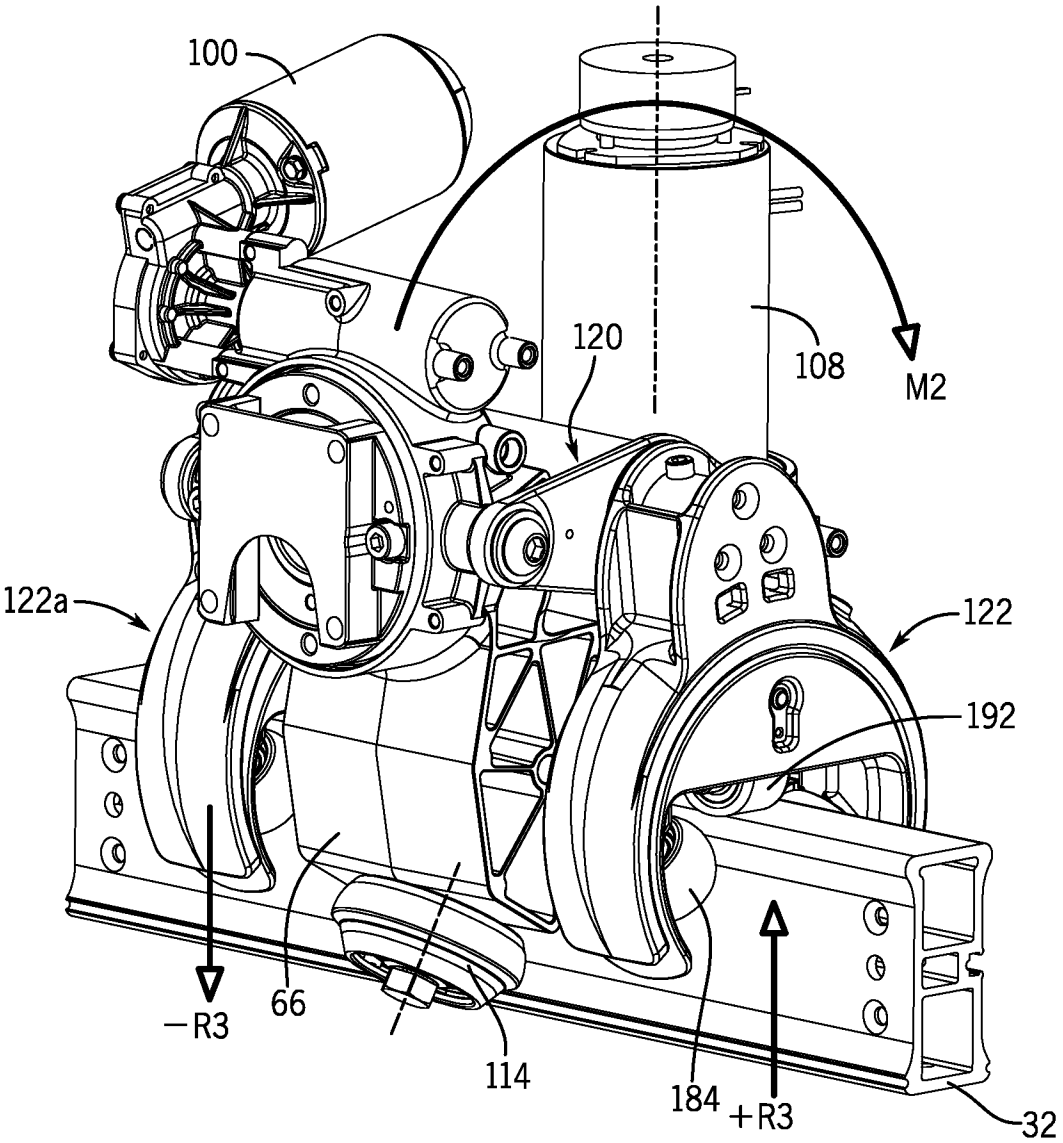
FIG. 16 illustrates a perspective view of components of the stairlift and a portion of the rail, showing forces acting thereon.

In some embodiments, the two bogie units 122, 122*a* are equally spaced from the central drive unit 104 to compensate for the moment M2, see FIG. 16. Reactive forces +R3 and −R3 shown in FIG. 16 are equal and opposite forces that resist and compensate for the otherwise destabilizing effect of the M2 moment. The farther apart forces +R3 and −R3 are, the smaller the required reactive force. However, the separation distance of each bogie unit 122, 122*a* from the central drive unit 104 can be chosen based on desired operational characteristics, such as reducing the difficulty the carriage 28 encounters in navigating turns. For example, the greater the separation distance, the more difficult it is to navigate turns, the higher a rider seat height has to be, and the longer the rail extensions become at the ends of the travel path at the top and bottom of a stairway 24 or other travel path.

Each bogie ball 146 rotates relative to its partially enclosing bogie socket 144 and the bogie ball 146 maintains a fixed orientation relative to the rail 26. When traversing the rail 26, the bottom end of each bogie ball 146 remains generally perpendicular to the direction of travel of the bogie ball 146 on the rail 26. The longitudinal axis 174 of each bogie ball 146 can be maintained at a point below the top surface 36 of the rail 26 so that the push or pull of the central drive unit 104 lets each bogie unit 122, 122*a* "float" through a curve while staying engaged on the rail 26. The spring loading of the bogie roller 192 engaged with the top surface 36 of the rail 26 allows each bogie unit 122, 122*a* to adapt to and/or accommodate dimensional variations in the rail 26, for example, due to an extrusion and/or bending process utilized in fabricating the rail 26. If the longitudinal axis 174 of the respective bogie ball 146 is not maintained below the top surface 36 of the rail 26, these components could lock on a rail like a brake.

The carriage 28 provides a smooth transition mechanism as non-straight portions of the rail 26 are navigated. The independent, spherical pivoting of each bogie ball 146 relative to its bogie socket 144 allows the carriage 28 to automatically adjust to changes in the travel path of the carriage 28, as well as minor differences, irregularities, etc. in the rail 26.

The yoke assembly 120 allows for the bogie units 122, 122*a* to pivot relative to the frame 66 and to rotate relative to the frame 66. The 2-axis pivoting-yoke motions allow the bogie units 122, 122*a* to move vertically and laterally in an orbit defined by the limitations of the rail travel path and the maximum and minimum dual rotations and restricted to a single vertically-oriented plane for each bogie unit 122, 122*a*. Additionally, the yoke 124 causes the two bogie units 122, 122*a* to move in unison with each other, thus allowing the bogie units 122, 122*a* to compensate for the arc of a curve in a manner akin to a railroad car's bogies on railroad track curves; the bogie units 122, 122*a* performing this bogie function in three dimensions. The vertical motion of the yoke 124 allows tracking of the bogie units 122, 122*a* and the central drive unit 104 through elevational angle changes, while the lateral motion of the yoke 124 allows for tracking through horizontal turns. Similarly, combined vertical and lateral motion of the yoke 124 allows for tracking through helical turns.

In operation, the carriage 28 is mounted to the rail 26 and is configured to traverse the rail 26 using the drive gear 112, the main drive motor 108 and related components. The central drive unit 104 drives the carriage 28 along the rail 26 while the combined yoke assembly 120 and bogie units 122, 122*a* control the orientation of the carriage 28 relative to the rail 26. The orientation of the load support 82 on the carriage 28 is controlled by the support-leveling mechanism 84 based on the position of the central drive unit 104.

Figure 17A:
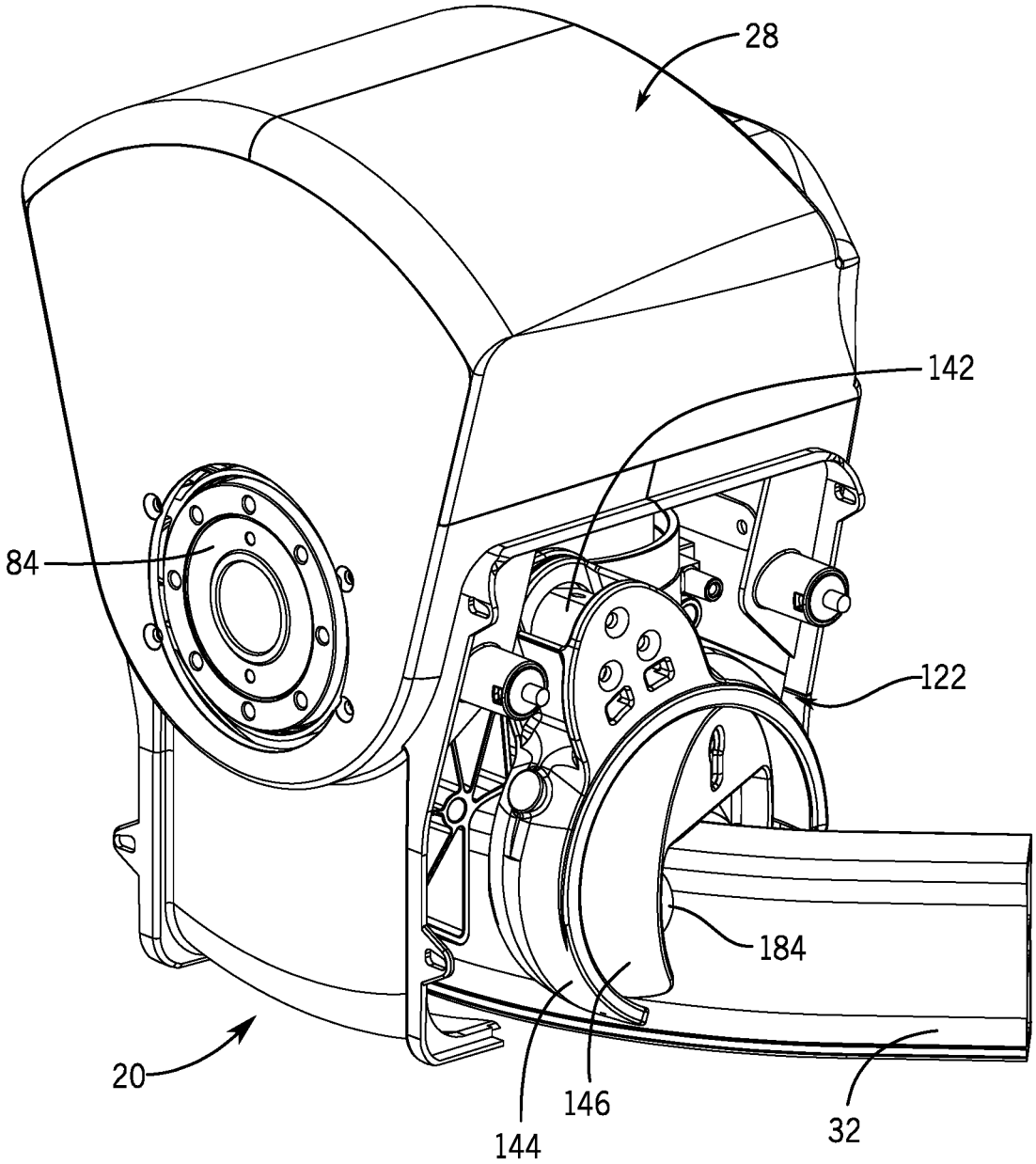
FIG. 17A illustrates a perspective view of components of the stairlift and a portion of the rail showing the bogie ball rotating on a purely horizontal turn or bend in the rail.
Figure 17B:
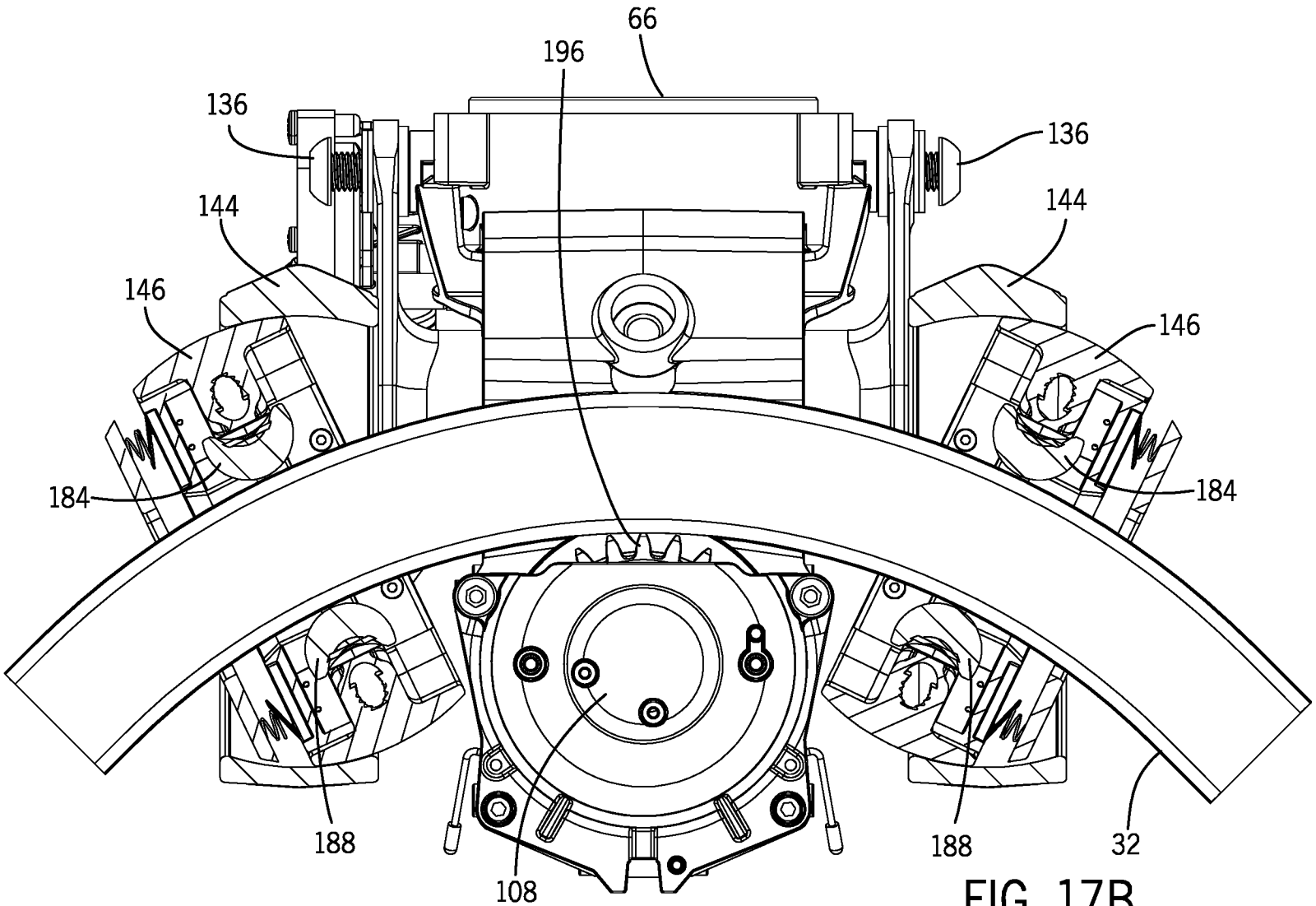
FIG. 17B illustrates a bottom plan view of components of the stairlift and a portion of the rail showing the bogie ball rotating on the purely horizontal turn or bend in the rail shown in FIG. 17A.
Figure 18A:
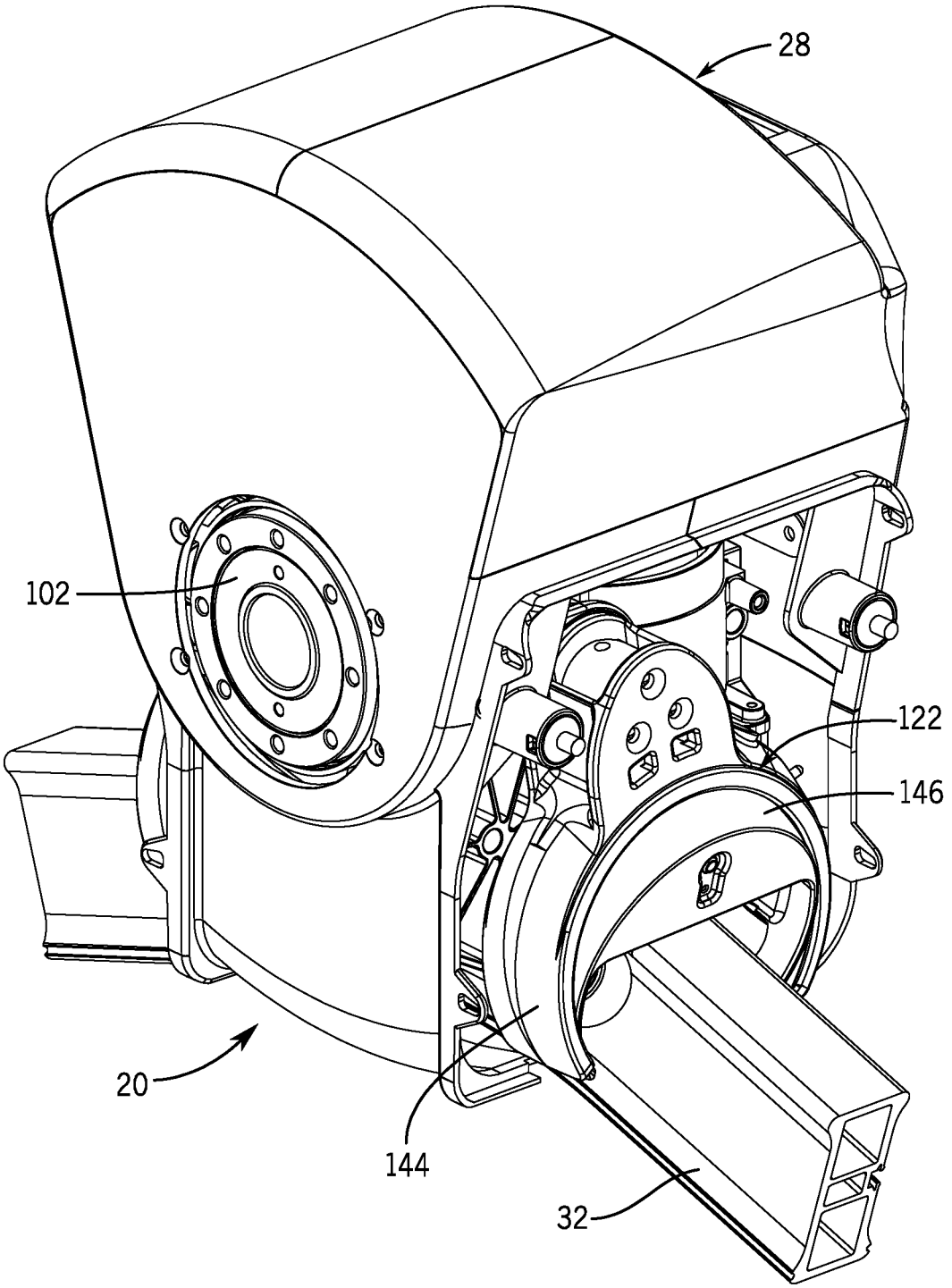
FIG. 18A illustrates a perspective view of components of the stairlift and a portion of the rail showing the bogie ball rotating on an angle change in the rail.
Figure 18B:
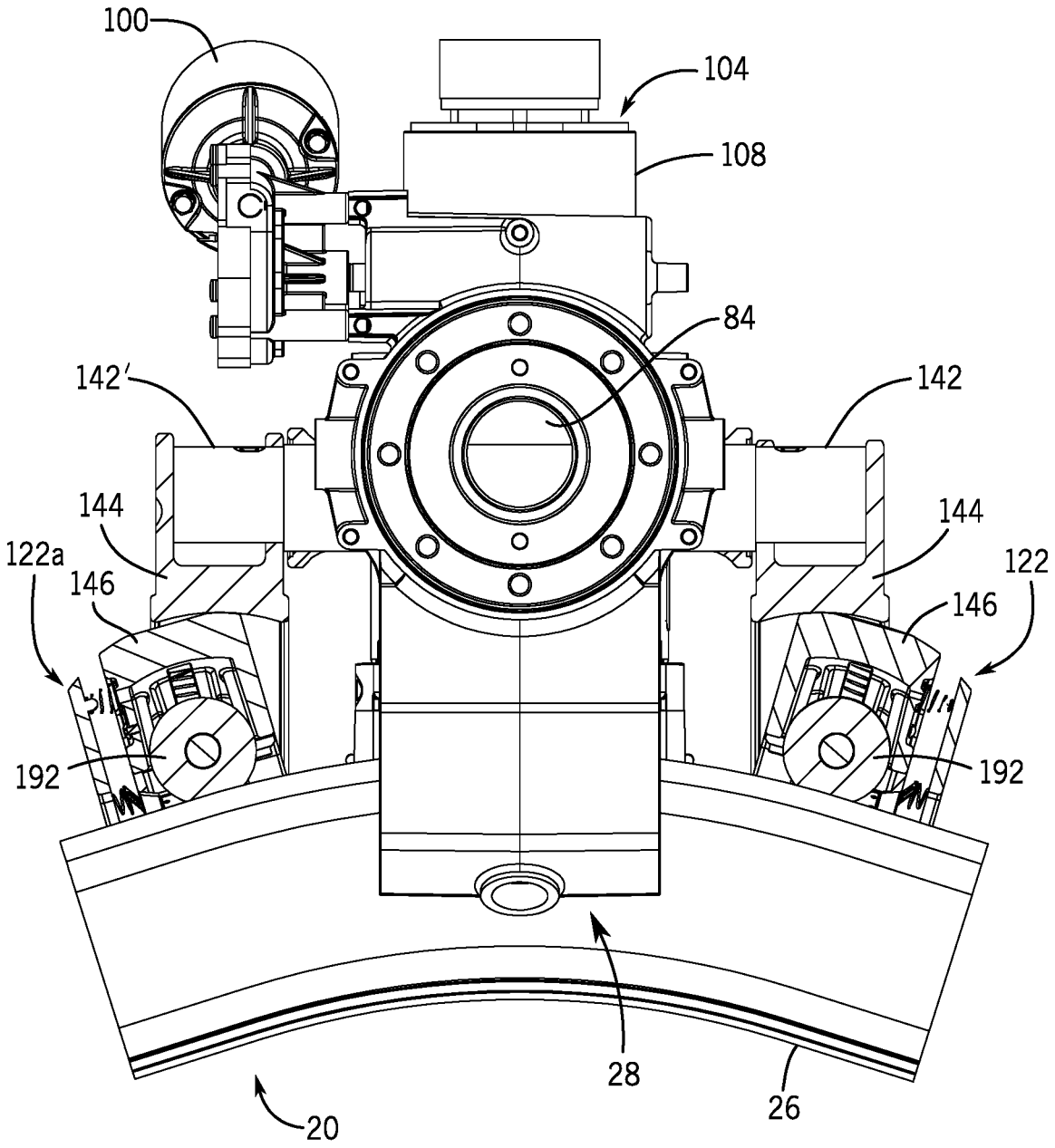
FIG. 18B illustrates a bottom plan view of components of the stairlift and a portion of the rail showing the bogie ball rotating on the angle change shown in FIG. 18A.
Figure 19A:
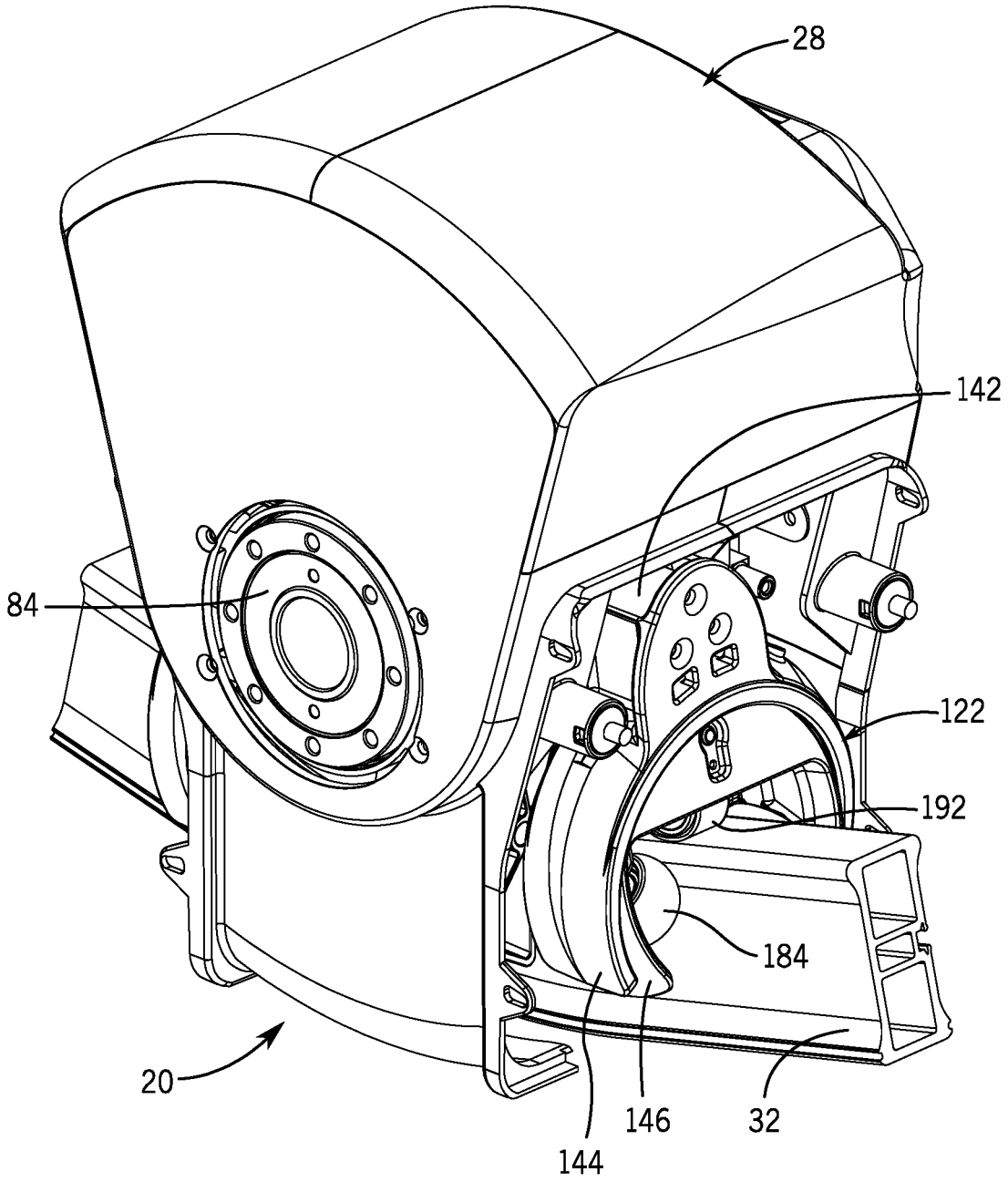
FIG. 19A illustrates a perspective view of components of the stairlift and a portion of the rail showing the bogie ball rotating on an angle change in the rail.
Figure 19B:
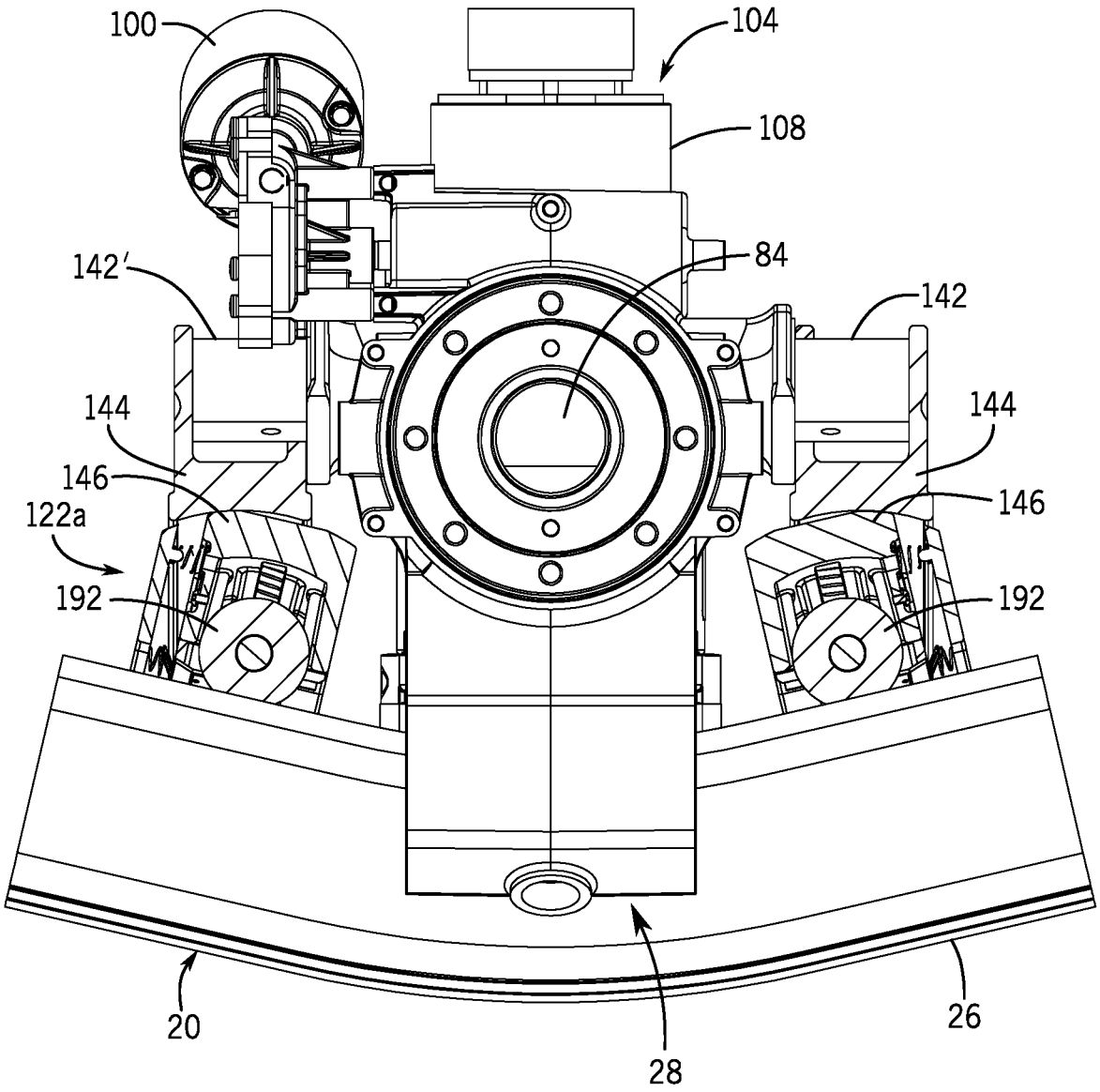
FIG. 19B illustrates a bottom plan view of components of the stairlift and a portion of the rail showing the bogie ball rotating on the angle change shown in FIG. 19A.

As the carriage 28 enters a generally flat turn, the bogie ball 146 of the leading bogie unit 122 begins to rotate. For example, the bogie ball 146 can rotate as generally seen in FIGS. 17A and 17B on a purely horizontal turn or bend in the rail 26. Similarly, if the carriage 28 is entering an angle change in the rail 26, the bogie ball 146 of the leading bogie unit 122 would rotate in a different manner. For example, the bogie ball 146 can rotate as generally seen in FIGS. 18A and 18B, 19A and 19B on a purely vertical angle change or bend in the rail 26. When the carriage 28 encounters a more complex change in the rail 26, the leading bogie ball 146 will rotate spherically in whatever manner is necessary to keep the rollers 184, 188, 192 in appropriate engagement with the rail 26.

If the vertical positioning of the central drive unit 104 and the bogie units 122, 122*a* changes, the yoke assembly 120 allows for adjustment as needed. The carriage 28 operates in an analogous manner as it exits any rail curve, angle change, etc.

Many modifications and other embodiments of the disclosure set forth herein will come to mind to one skilled in the art to which these disclosed embodiments pertain having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the disclosure. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure. In this regard, for example, different combinations of elements and/or functions than those explicitly described above are also contemplated within the scope of the disclosure. Although specific terms are employed herein, they are used in a generic and descriptive sense only and not for purposes of limitation.

While particular embodiments are illustrated in and described with respect to the drawings, it is envisioned that those skilled in the art may devise various modifications without departing from the spirit and scope of the appended claims. It will therefore be appreciated that the scope of the disclosure and the appended claims is not limited to the specific embodiments illustrated in and discussed with respect to the drawings and that modifications and other embodiments are intended to be included within the scope of the disclosure and appended drawings. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure and the appended claims.

What is claimed is:

1. A stairlift comprising:

a rail; and a carriage including a frame, a central drive unit mounted to the frame, the central drive unit including a drive motor and a drive gear coupled to the drive motor for rotation therewith, a yoke assembly pivotably mounted to the frame, and a first bogie unit attached to the yoke assembly and a second bogie unit attached to the yoke assembly, wherein each bogie unit includes a bogie socket fixedly mounted to the yoke assembly, a bogie ball pivotable within the bogie socket, the bogie socket having a wall defining a passageway having a partial spherical shape and the bogie ball having an exterior surface having a partial spherical shape, wherein the walls of the bogie socket and the bogie ball maintain contact during operation to hold the bogie ball within the bogie socket while allowing for rotation of the bogie ball in three dimensions relative to the bogie socket and the yoke assembly, and a plurality of bogie ball rollers mounted on the bogie ball which mount the bogie ball on the rail.

2. The stairlift of claim 1, wherein the rail has an hourglass cross-sectional shape.

3. The stairlift of claim 1, wherein the yoke assembly includes a rigid yoke pivotably mounted to the central drive unit, and a shaft rotatable within the rigid yoke, wherein the bogie socket of each of the first and second bogie units is rigidly fixed to the shaft.

4. The stairlift of claim 3, wherein each plurality of bogie ball rollers includes a top roller engaged with at least a portion of an upper surface of the rail, and a pair of side rollers, wherein each side roller is engaged with at least a portion of a side surface of the rail.

5. The stairlift of claim 4, wherein in each bogie unit, each side roller has a rotational axis which is angled relative to a rotational axis of the top roller.

6. The stairlift of claim 5, wherein each top roller is cylindrical and each side roller is spherical.

7. The stairlift of claim 1, wherein the rail has a rack thereon; and the central drive unit further includes a drive roller coupled to the drive motor for rotation therewith, the drive roller being engaged against a side surface of the rail, and the drive gear is engaged with the rack.

8. The stairlift of claim 1, wherein the carriage further comprises a seat mounted to the central drive unit by a seat leveling mechanism.

9. The stairlift of claim 1, wherein each plurality of bogie ball rollers includes a top roller engaged with at least a portion of an upper surface of the rail, and a pair of side rollers, wherein each side roller engaged with at least a portion of a side surface of the rail.

10. The stairlift of claim 9, wherein in each bogie unit, each side roller has a rotational axis which is angled relative to a rotational axis of the top roller.

11. The stairlift of claim 10, wherein each top roller is cylindrical and each side roller is spherical.

12. A carriage for a stairlift mounted to a rail, comprising:

a frame;

a central drive unit mounted to the frame, the central drive unit including a drive motor and a drive gear coupled to the drive motor for rotation therewith;

a seat mounted to the central drive unit;

a yoke assembly pivotably mounted to the frame; and a first bogie unit attached to the yoke assembly and a second bogie unit attached to the yoke assembly, wherein each bogie unit includes a bogie socket fixedly mounted to the yoke assembly, a bogie ball pivotable within the bogie socket, the bogie socket having a wall defining a passageway having a partial spherical shape and the bogie ball having an exterior surface having a partial spherical shape, wherein the walls of the bogie socket and the bogie ball maintain contact during operation to hold the bogie ball within the bogie socket while allowing for rotation of the bogie ball in three dimensions relative to the bogie socket and the yoke assembly, and a plurality of bogie ball rollers mounted on the bogie ball and which are configured to mount the bogie ball to the rail.

13. The carriage of claim 12, wherein the yoke assembly includes a rigid yoke pivotably mounted to the central drive unit, and a shaft rotatable within the rigid yoke, wherein the bogie socket of each of the first and second bogie units is rigidly fixed to the shaft.

14. The carriage of claim 13, wherein each plurality of bogie ball rollers includes a top roller configured to engage at least a portion of an upper surface of the rail, and a pair of side rollers, wherein each side roller is configured to engage at least a portion of a side surface of the rail.

15. The carriage of claim 14, wherein in each bogie unit, each side roller has a rotational axis which is angled relative to a rotational axis of the top roller.

16. The carriage of claim 15, wherein each top roller is cylindrical and each side roller is spherical.

17. The carriage of claim 12, wherein the central drive unit further includes a drive roller coupled to the drive motor for rotation therewith, the drive roller being configured to be engaged against a side surface of the rail, and the drive gear being configured to be engaged with a rack of the rail.

18. The carriage of claim 12, wherein each plurality of bogie ball rollers includes a top roller engaged with at least a portion of an upper surface of the rail, and a pair of side rollers, wherein each side roller engaged with at least a portion of a side surface of the rail.

19. The carriage of claim 18, wherein in each bogie unit, each side roller has a rotational axis which is angled relative to a rotational axis of the top roller.

20. The carriage of claim 19, wherein each top roller is cylindrical and each side roller is spherical.

* * * * *